US007777694B2

(12) United States Patent
Han

(10) Patent No.: US 7,777,694 B2
(45) Date of Patent: Aug. 17, 2010

(54) PLASMA DISPLAY APPARATUS AND METHOD FOR DRIVING THE SAME

(75) Inventor: Jung Gwan Han, Gyeongsangbuk-do (KR)

(73) Assignee: LG Electronics Inc., Seoul (KR)

( * ) Notice: Subject to any disclaimer, the term of this patent is extended or adjusted under 35 U.S.C. 154(b) by 1034 days.

(21) Appl. No.: 11/480,894

(22) Filed: Jul. 6, 2006

(65) Prior Publication Data

US 2007/0132667 A1 Jun. 14, 2007

(30) Foreign Application Priority Data

Dec. 12, 2005 (KR) ..... 10-2005-0122200

(51) Int. Cl.
*G09G 3/28* (2006.01)
*G09G 3/10* (2006.01)

(52) U.S. Cl. ..... 345/60; 315/169.4

(58) Field of Classification Search ..... 345/30–111; 315/169.1, 169.4
See application file for complete search history.

(56) References Cited

U.S. PATENT DOCUMENTS

RE37,083 E 3/2001 Kanazawa et al.
2006/0152167 A1 7/2006 Takagi et al.

FOREIGN PATENT DOCUMENTS

| | | | |
|---|---|---|---|
| EP | 1 587 052 | A2 | 10/2005 |
| EP | 1 612 763 | A2 | 1/2006 |
| EP | 1 736 955 | A1 | 12/2006 |
| EP | 1 780 694 | A2 | 5/2007 |
| JP | 7-295506 | A | 11/1995 |
| KR | 10-2001-0077740 | A | 8/2001 |
| KR | 10-2006-0067887 | A | 6/2006 |

*Primary Examiner*—Srilakshmi K Kumar
(74) *Attorney, Agent, or Firm*—Birch, Stewart, Kolasch & Birch, LLP

(57) ABSTRACT

A plasma display apparatus and a driving method thereof are provided. A plasma display apparatus according to an embodiment of the present invention comprises a plasma display panel comprising an address electrode, a data drive integrated circuit (IC), connected to the address electrode, for supplying a voltage of a data signal supplied from a data voltage source and a bias voltage supplied from a bias voltage source to the address electrode, a bias voltage supply control switch for controlling the bias voltage supplied by the data drive IC, and a data voltage supply control switch for controlling the voltage of the data signal supplied by the data drive IC.

17 Claims, 27 Drawing Sheets

PLASMA DISPLAY APPARATUS AND METHOD FOR DRIVING THE SAME

This Nonprovisional application claims priority under 35 U.S.C. §119(a) on Patent Application No. 2005-0122200 filed in Korea on Dec. 12, 2005 the entire contents of which are hereby incorporated by reference.

BACKGROUND OF THE INVENTION

1. Field of the Invention

This document generally relates to a display apparatus, and more particularly, to a plasma display apparatus and a driving method thereof.

2. Discussion of Related Art

In general, a plasma display apparatus of a display apparatus has a plasma display panel, and a driver for driving the plasma display panel.

In general, a plasma display panel has a front panel and a rear panel. A barrier rib formed between the front panel and the rear panel forms one discharge cell. Each cell is filled with an inert gas containing a primary discharge gas, such as neon (Ne), helium (He) or a mixed gas of Ne+He, and a small amount of xenon (Xe).

A plurality of the cells form one pixel. For example, a red (R) discharge cell, a green (G) discharge cell, and a blue (B) discharge cell form one pixel.

In the plasma display panel constructed above, when the inert gas is discharged with a high frequency voltage, it generates vacuum ultraviolet rays. Phosphors formed between the barrier ribs are excited to display images.

The plasma display panel constructed above can be made thin and light, and has thus been in the spotlight as the next-generation display devices.

A plurality of electrodes, such as a scan electrode Y, a sustain electrode Z, and an address electrode X, are formed in the plasma display panel. A predetermined driving voltage is applied to the plurality of electrodes to generate a discharge, whereby images are displayed.

A driver Integrated Circuit (IC) for supplying the driving voltage to the electrodes of the plasma display panel is connected to the electrodes.

For example, a data driver IC can be connected to the address electrode X of the electrodes of the plasma display panel, and a scan driver IC can be connected to the scan electrode Y of the electrodes of the plasma display panel.

A thing comprising the plasma display panel in which a plurality of electrodes are formed and a driver for supplying a predetermined driving voltage to the plurality of electrodes of the plasma display panel, as described above, is called a "plasma display apparatus".

In this case, an exemplary structure of the plasma display apparatus comprising the related art data drive IC for supplying the driving voltage to the address electrode X of the plasma display panel will be described below with reference to FIG. 1.

FIG. 1 is a view illustrating an exemplary structure of a plasma display apparatus having a data drive IC in the related art.

Referring to FIG. 1, the plasma display apparatus in the related art comprises top switches Qt1, Qt2, Qt3 and bottom switches Qb1, Qb2, and Qb3, which are connected in series between a data voltage source (not shown) for supplying a data voltage Vd and a base voltage source (not shown) for supplying a base voltage GND, respectively.

Address electrodes X of the plasma display panel are connected between the top switches Qt1, Qt2, and Qt3 and the bottom switches Qb1, Qb2, and Qb3.

Each of the top switches Qt1, Qt2, and Qt3 and each of the bottom switches Qb1, Qb2, and Qb3 form one data drive IC.

In other words, the top switch Qt1 and the bottom switch Qb1 form a data drive IC (reference numeral "100"). The data drive IC of reference numeral "100" is connected to the address electrode Xa of the plurality of address electrodes X of the plasma display panel.

In this manner, a data drive IC (reference numeral "101") is connected to an address electrode Xb, and a data drive IC (reference numeral "102") is connected to an address electrode Xc.

Meanwhile, it has been shown in FIG. 1 that the number of the data drive ICs comprised in the related art plasma display apparatus is three. However, the number of the data drive ICs may be varied depending on the number of the address electrodes X.

The operation of the plasma display apparatus in the related art will be described below with reference to FIG. 2.

FIG. 2 illustrates an operating timing diagram illustrating the operation of the plasma display apparatus in the related art.

Referring to FIG. 2, if the top switch Qt1 of the data drive IC 100 is turned on in the address period, the data voltage Vd from the data voltage source (not shown) is supplied to the address electrode Xa through the top switch Qt1. Accordingly, a voltage of the address electrode Xa rises up to Vd and is then kept, as shown in FIG. 2.

Thereafter, if the top switch Qt1 of the data drive IC 100 is turned off and the bottom switch Qb1 of the data drive IC 100 is turned on, the voltage of the address electrode Xa becomes a base voltage GND. That is, the top switch Qt1 and the bottom switch Qb1 alternately operate to supply the address electrode Xa with a data signal of the data voltage Vd.

The switching operation for supplying the data signal may be applied to the data drive IC 101 and the data drive IC 102 in the same manner.

In the related art plasma display apparatus operating as described above, switching elements used for each data drive IC as shown in FIG. 1 must have a relatively high withstanding voltage characteristic.

For example, it is assumed that a magnitude of the data voltage Vd supplied by the above-mentioned data voltage source (not shown) is 60V and a resistance value of each of the top switches Qt1, Qt2, and Qt3 is R.

In this case, when the data voltage Vd is supplied to the address electrode Xa through the data drive IC (reference numeral 100 of FIG. 1), a current flowing through the top switch Qt1 and a magnitude of power consumed in the top switch Qt1 can be expressed in the following equation 1.

$$i=60\text{V}/R$$

$$W=i\times 60\text{V} \qquad \text{[Equation 1]}$$

Here "i" denotes a magnitude of current flowing through the top switch Qt1, and "W" denotes a magnitude of power consumed in the top switch Qt1.

From Equation 1, it can be seen that the above-mentioned top switch Qt1 consumes power of i×60V when being driven.

At this time, heat is generated from the top switch Qt1 in proportion to the consumption power W.

For example, assuming that the resistance value R of the top switch Qt1 is 30Ω (ohm), heat of (60/30)×60=120 W is generated from the top switch Qt1.

In summary, the top switch Qt1 must have a withstanding voltage characteristic enough to withstand heat generated according to power of i×60V.

As described above, the switching elements with a relatively high withstanding voltage characteristic are expensive. Accordingly, a problem arises in that the production cost of the plasma display apparatus becomes further high.

More particularly, in the case of a specific pattern in which, for example, picture data are repeated between logic values 1 and 0, excessively high heat is generated from the top switch Qt1. Accordingly, there is a problem in that damage, such as the burning of the top switch Qt1, occurs.

SUMMARY OF THE INVENTION

Accordingly, an object of the present invention is to solve at least the problems and disadvantages of the background art.

This document has been made to prevent thermal and electrical damage of a data drive IC.

Another aspect of the present invention is to provide a plasma display apparatus and a driving method thereof, in which a stabilized operation can be provided although a withstanding voltage characteristic of a data drive IC is lowered, thereby enabling a relatively low production cost.

According to an aspect of the present invention, there is provided a plasma display apparatus comprising a plasma display panel comprising an address electrode, a data drive integrated circuit (IC), connected to the address electrode, for supplying a voltage of a data signal supplied from a data voltage source and a bias voltage supplied from a bias voltage source to the address electrode, a bias voltage supply control switch for controlling the bias voltage supplied by the data drive IC, and a data voltage supply control switch for controlling the voltage of the data signal supplied by the data drive IC.

According to another aspect of the present invention, there is provided a method of driving a plasma display apparatus for driving a plasma display panel comprising a scan electrode and an address electrode, the method comprising supplying a reset signal to the scan electrode during a reset period of at least one subfield, supplying a bias voltage to the address electrode during an address period of at least one subfield, and supplying a voltage of a data signal to the address electrode during the address period of at least one subfield.

According to still another aspect of the present invention, there is provided a method of driving a plasma display apparatus comprising a first substrate comprising a scan electrode and a sustain electrode, a second substrate comprising an address electrode and a barrier rib, and a driver for supplying a driving signal to the address electrode, the method comprising supplying a reset signal to the scan electrode during a reset period of at least one subfield, supplying a bias voltage to the address electrode during an address period of at least one subfield, and supplying a voltage of a data signal to the address electrode during the address period of at least one subfield.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
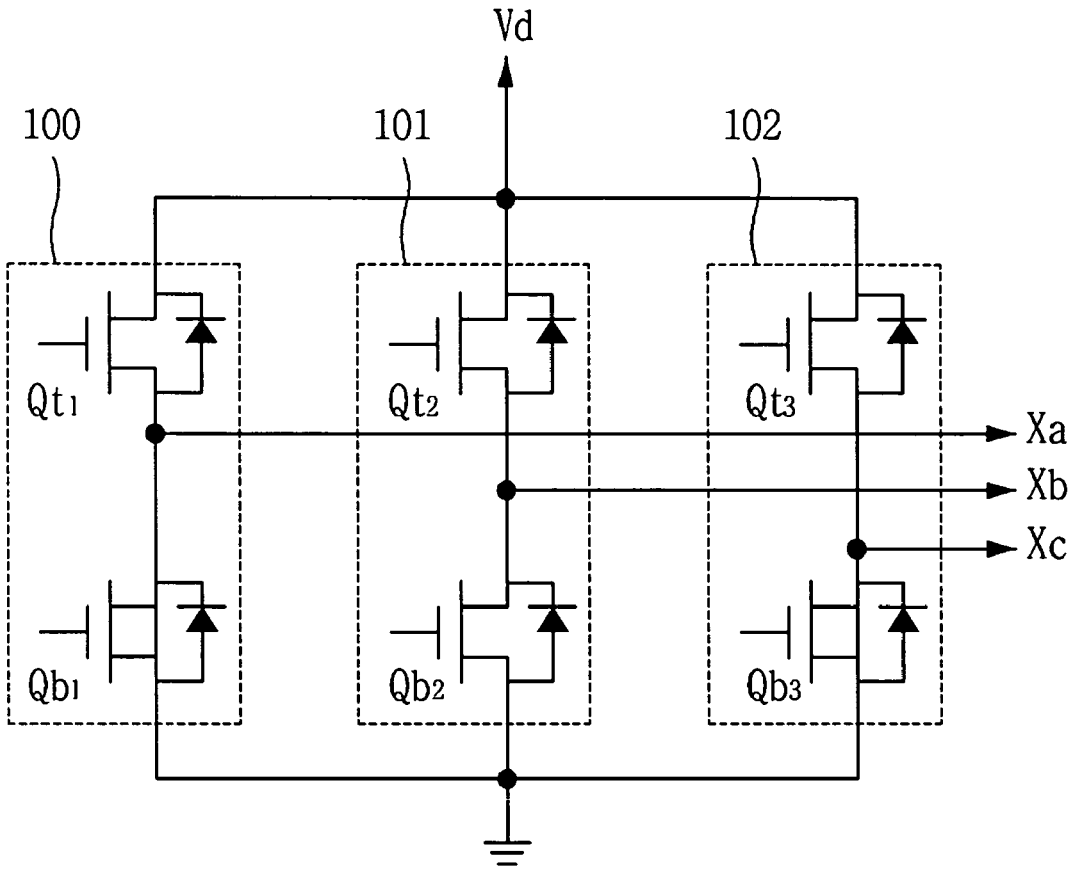
Fig. 1 RELATED ART
FIG. 1 is a view illustrating an exemplary structure of a plasma display apparatus having a data drive IC in the related art.
Figure 2:
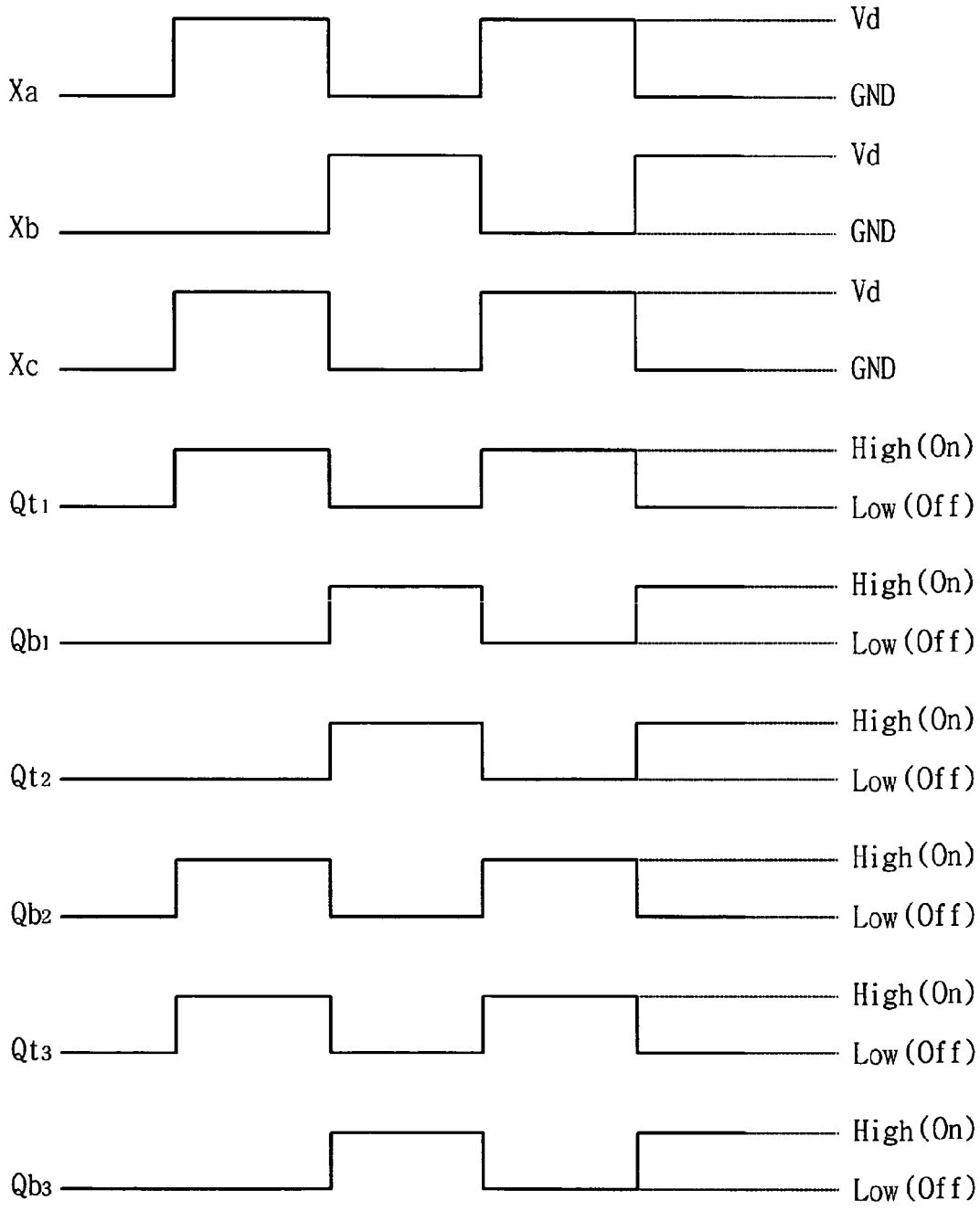
Fig. 2 RELATED ART
FIG. 2 illustrates an operating timing diagram illustrating the operation of the plasma display apparatus in the related art.

Specific embodiments of the present invention will be described in a more detailed manner with reference to the drawings.

A plasma display apparatus according to an embodiment of the present invention comprises a plasma display panel comprising an address electrode, a data drive IC, connected to the address electrode, for supplying a voltage of a data signal supplied from a data voltage source and a bias voltage supplied from a bias voltage source to the address electrode, a bias voltage supply control switch for controlling the bias voltage supplied by the data drive IC, and a data voltage supply control switch for controlling the voltage of the data signal supplied by the data drive IC.

The data drive IC is preferably formed on a single board independently of the data voltage supply control switch and the bias voltage supply control switch.

The data drive IC preferably comprises a top switch and a bottom switch, one terminal of the top switch is commonly connected to the data voltage supply control switch and the bias voltage supply control switch, and the other terminal of the top switch is connected to one terminal of the bottom switch, and the other terminal of the bottom switch is grounded, and the address electrode is connected between the other terminal of the top switch and one terminal of the bottom switch.

The bias voltage is preferably more than a ground level voltage and is less than the voltage of the data signal.

A magnitude of the bias voltage preferably approximately equals to half the voltage of the data signal.

The number of bias voltage supply control switch is preferably plural, and the plurality of bias voltage supply control switch are preferably connected to a plurality of bias voltage sources for supplying the bias voltages of different magnitudes, respectively.

The number of bias voltage supply control switch preferably equals to 2 to 5.

Each of the magnitudes of the bias voltages, which the plurality of bias voltage sources respectively connected to the plurality of bias voltage supply control switch supply, is preferably more than a ground level voltage and is less than the voltage of the data signal.

The plurality of bias voltage supply control switch each preferably comprise a first bias voltage supply control switch for supplying a first bias voltage and a second bias voltage supply control switch for supplying a second bias voltage less than the first bias voltage, and a difference between the first bias voltage and the second bias voltage approximately equals to a difference between the first bias voltage and the data voltage.

The plurality of bias voltage supply control switch each preferably comprise a first bias voltage supply control switch for supplying a first bias voltage, a second bias voltage supply control switch for supplying a second bias voltage less than the first bias voltage, and a third bias voltage supply control switch for supplying a third bias voltage less than the second bias voltage, and a difference between the first bias voltage and the voltage of the data signal approximately equals to a difference between the first bias voltage and the second bias voltage and a difference between the second bias voltage and the third bias voltage.

The plasma display apparatus preferably further comprises a reverse blocking unit for blocking an inverse current flowing in a direction of the bias voltage source, between the bias voltage source and the bias voltage supply control switch and/or between a connection terminal of the data drive IC and the data voltage supply control switch and the bias voltage supply control switch.

The reverse blocking unit preferably comprises a reverse blocking diode, and an anode of the reverse blocking diode is disposed in the direction of the bias voltage source.

A plasma display apparatus according to another embodiment of the present invention, there is provided a method of driving a plasma display apparatus for driving a plasma display panel comprising a scan electrode and an address electrode, the method comprising supplying a reset signal to the scan electrode during a reset period of at least one subfield, supplying a bias voltage to the address electrode during an address period of at least one subfield, and supplying a voltage of a data signal to the address electrode during the address period of at least one subfield.

A magnitude of the bias voltage preferably approximately equals to half the voltage of the data signal.

The supplying of the bias voltage is preferably to supply the bias voltages of different magnitudes a plurality of times.

The supplying of the bias voltage preferably comprises supplying a first bias voltage to the address electrode and supplying a second bias voltage to the address electrode. Magnitudes of the first bias voltage and the second bias voltage are preferably more than a ground level voltage and are less than the voltage of the data signal, and a difference between the first bias voltage and the second bias voltage preferably approximately equals to a difference between the first bias voltage and the data voltage.

The supplying of the bias voltage preferably comprises supplying a first bias voltage to the address electrode, supplying a second bias voltage to the address electrode, and supplying a third bias voltage to the address electrode. Magnitudes of the first bias voltage, the second bias voltage, and the third bias voltage are preferably more than a ground level voltage and are less than the voltage of the data signal. A difference between the first bias voltage and the voltage of the data signal preferably approximately equals to a difference between the first bias voltage and the second bias voltage and a difference between the second bias voltage and the third bias voltage.

A plasma display apparatus according to still another embodiment of the present invention, there is provided a method of driving a plasma display apparatus comprising a first substrate comprising a scan electrode and a sustain electrode, a second substrate comprising an address electrode and a barrier rib, and a driver for supplying a driving signal to the address electrode, the method comprising supplying a reset signal to the scan electrode during a reset period of at least one subfield, supplying a bias voltage to the address electrode during an address period of at least one subfield, and supplying a voltage of a data signal to the address electrode during the address period of at least one subfield.

It is preferred that a magnitude of the bias voltage approximately equals to half the voltage of the data signal.

The supplying of the bias voltage is preferably to supply the bias voltages of different magnitudes a plurality of times.

The present invention will now be described in detail in connection with specific embodiments with reference to the accompanying drawings.

Figure 3:
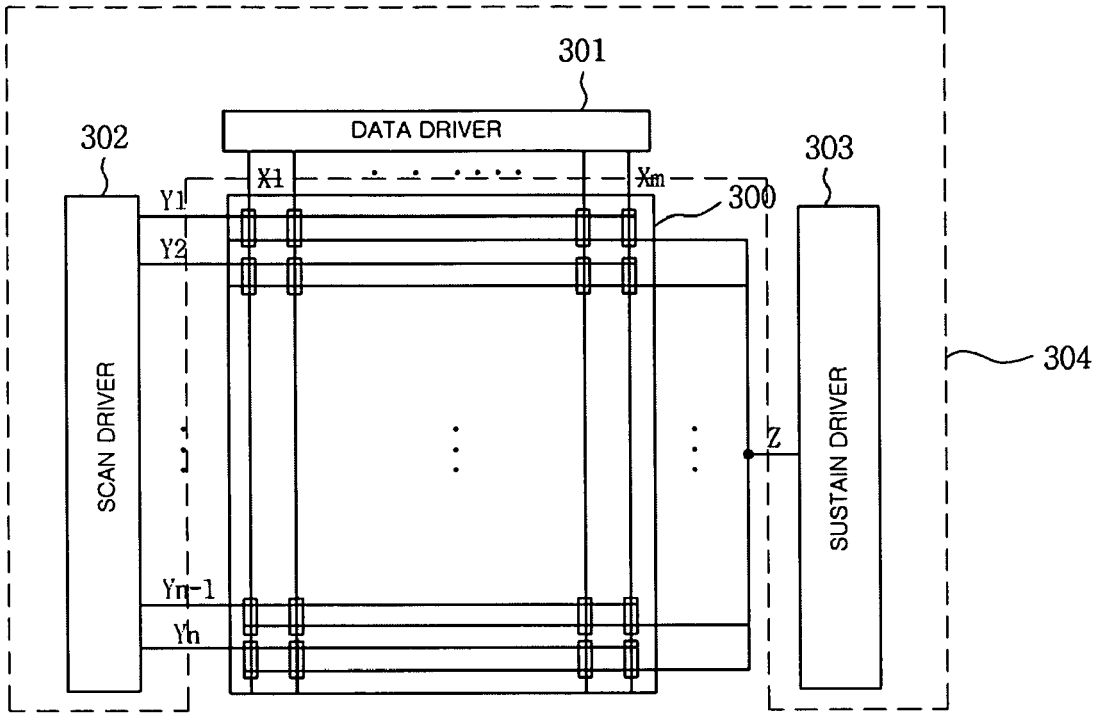
FIG. 3 is a view illustrating the structure of a plasma display apparatus according to an embodiment of the present invention.

FIG. 3 is a view illustrating the structure of a plasma display apparatus according to an embodiment of the present invention.

Referring to FIG. 3, the plasma display apparatus according to an embodiment of the present invention comprises a plasma display panel 300 and a driver 304.

The plasma display panel 300 has a first panel (not shown) and a second panel (not shown) coalesced with a predetermined distance therebetween, and has formed a plurality of electrodes, such as address electrodes X therein.

The structure of the plasma display panel 300 will be described in more detail below with reference to FIG. 4*a*.

Figure 4A:
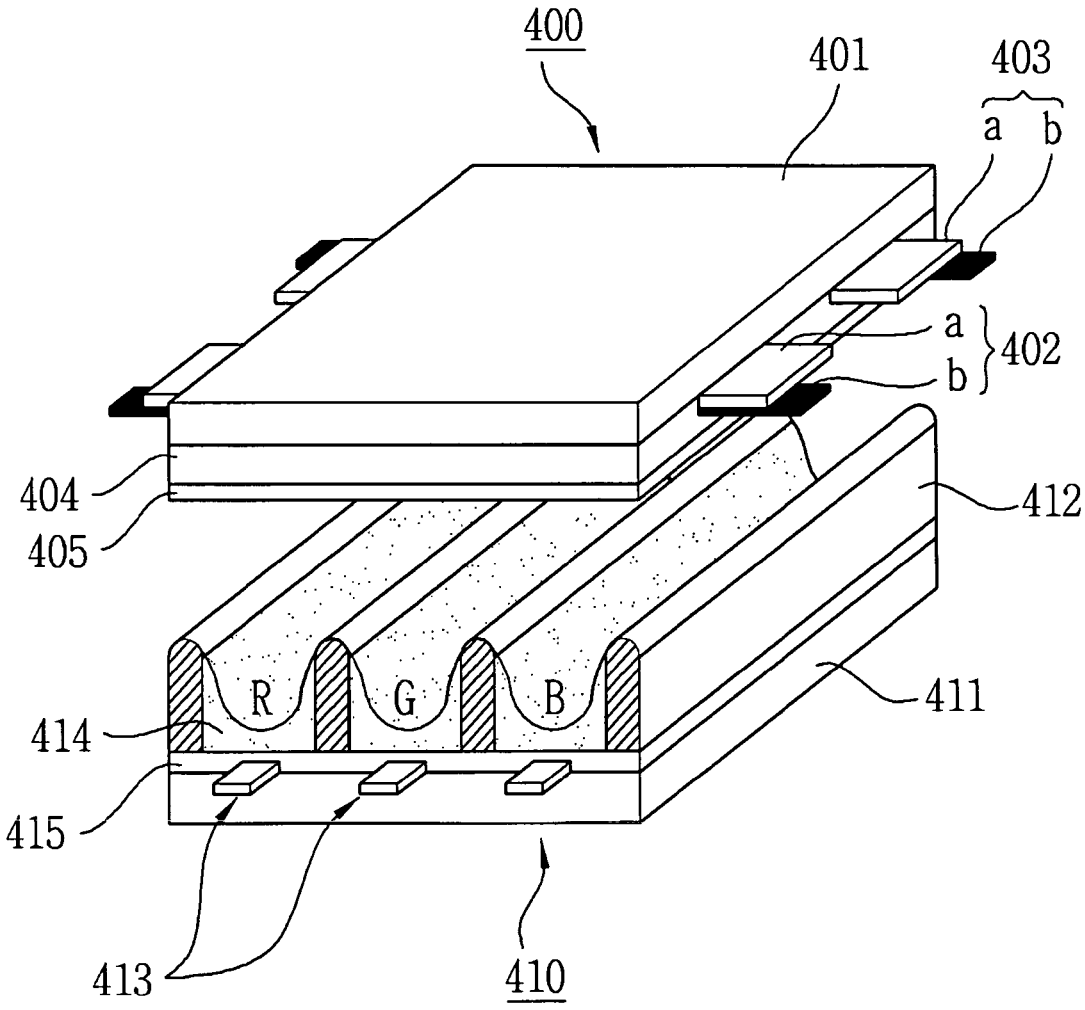
FIGS. 4*a* to 4*c* are views illustrating an exemplary structure of a plasma display panel in a plasma display apparatus according to an embodiment of the present invention.

FIG. 4*a* is a view illustrating an exemplary structure of a plasma display panel in the plasma display apparatus according to an embodiment of the present invention Referring to FIG. 4*a*, the plasma display panel 300 of the plasma display apparatus according to an embodiment of the present invention comprises a first panel 400 and a second panel 410 that are coalesced in parallel with a predetermined distance therebetween. In the first panel 400, a scan electrode 402, Y and a sustain electrode 403, Z are formed in a first substrate 401 serving as a display surface on which images are displayed. In the second panel 410, a plurality of address electrodes 413, Z crossing the scan electrode 402, Y and the sustain electrode 403, Z are arranged on a second substrate 411 serving as a rear surface.

The first panel 400 comprises plural pairs of the scan electrodes 402, Y and the sustain electrodes 403, Z for mutually discharging the other within one discharge space (i.e., a discharge cell) and sustaining the emission of the discharge cell. In other words, each of the scan electrode 402, Y and the sustain electrode 403, Z comprises a transparent electrode "a" made of a transparent ITO material and a bus electrode "b" made of a metal material.

The scan electrode 402, Y and the sustain electrode 403, Z are covered with one or more upper dielectric layers 404 for limiting the discharge current and providing insulation between the electrode pairs. A protection layer 405 on which magnesium oxide (MgO) is deposited in order to facilitate the discharge conditions is formed on the upper dielectric layer 404.

A plurality of barrier ribs 412 having a stripe type (or a well type), for forming a plurality of discharge spaces (i.e., discharge cells), are arranged in parallel in the second panel 410.

Furthermore, the plurality of address electrodes 413, Z that generate vacuum ultraviolet rays by performing an address discharge are disposed in parallel to the barrier ribs 412.

R, G, and B phosphors 414 that emit a visible ray for displaying images during the address discharge are coated on an upper side of the second panel 410. A lower dielectric layer 415 for protecting the address electrodes 413, Z is formed between the address electrodes 413, Z and the phosphors 414.

FIG. 4*a* shows only an example of the plasma display panel that may be applied to the present invention. It is, however, to be understood that the present invention is not limited to the plasma display panel shown in FIG. 4.

For example, it has been shown in FIG. 4*a* that the scan electrode 402, Y, the sustain electrode 403, Z, and the address electrodes 413, Z are formed in the plasma display panel 300. It is, however, to be noted that in the electrodes of the plasma display panel 300 to which the plasma display apparatus of the present invention may be applied, one or more of the scan electrode 402, Y and the sustain electrode 403, Z may be omitted.

Furthermore, it has also been shown in FIG. 4*a* that each of the scan electrode 402, Y and the sustain electrode 403, Z comprises only the transparent electrode "a" and the bus electrode "b". It is, however, to be noted that one or more of the scan electrode 402, Y and the sustain electrode 403, Z may comprise only the bus electrode "b".

Furthermore, it has been shown in FIG. 4*a* that the scan electrode 402, Y and the sustain electrode 403, Z are comprised in the first panel 400 and the address electrodes 413, Z are comprised in the second panel 410. It is, however, to be noted that all the electrodes may be formed in the first panel 400, or any one of the scan electrode 402, Y, the sustain electrode 403, Z, and the address electrodes 413, Z may be formed on the barrier rib 412.

In summary, the plasma display panel to which the present invention may be applied comprise the plurality of address electrodes 413, Z for supplying the driving voltage and may also comprise other conditions.

Furthermore, the address electrodes 413, Z can be divided. This will be described in more detail below.

Figure 4B:
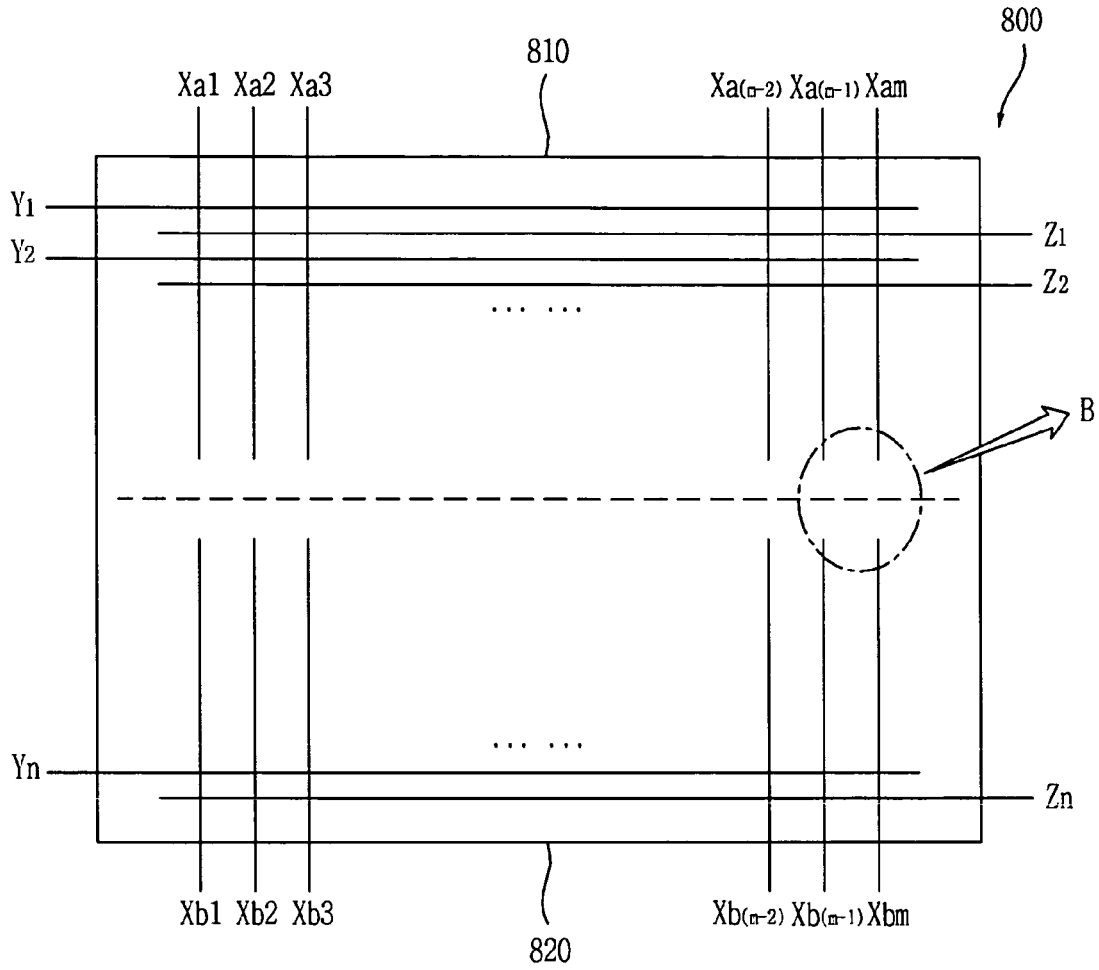
Figure 4C:
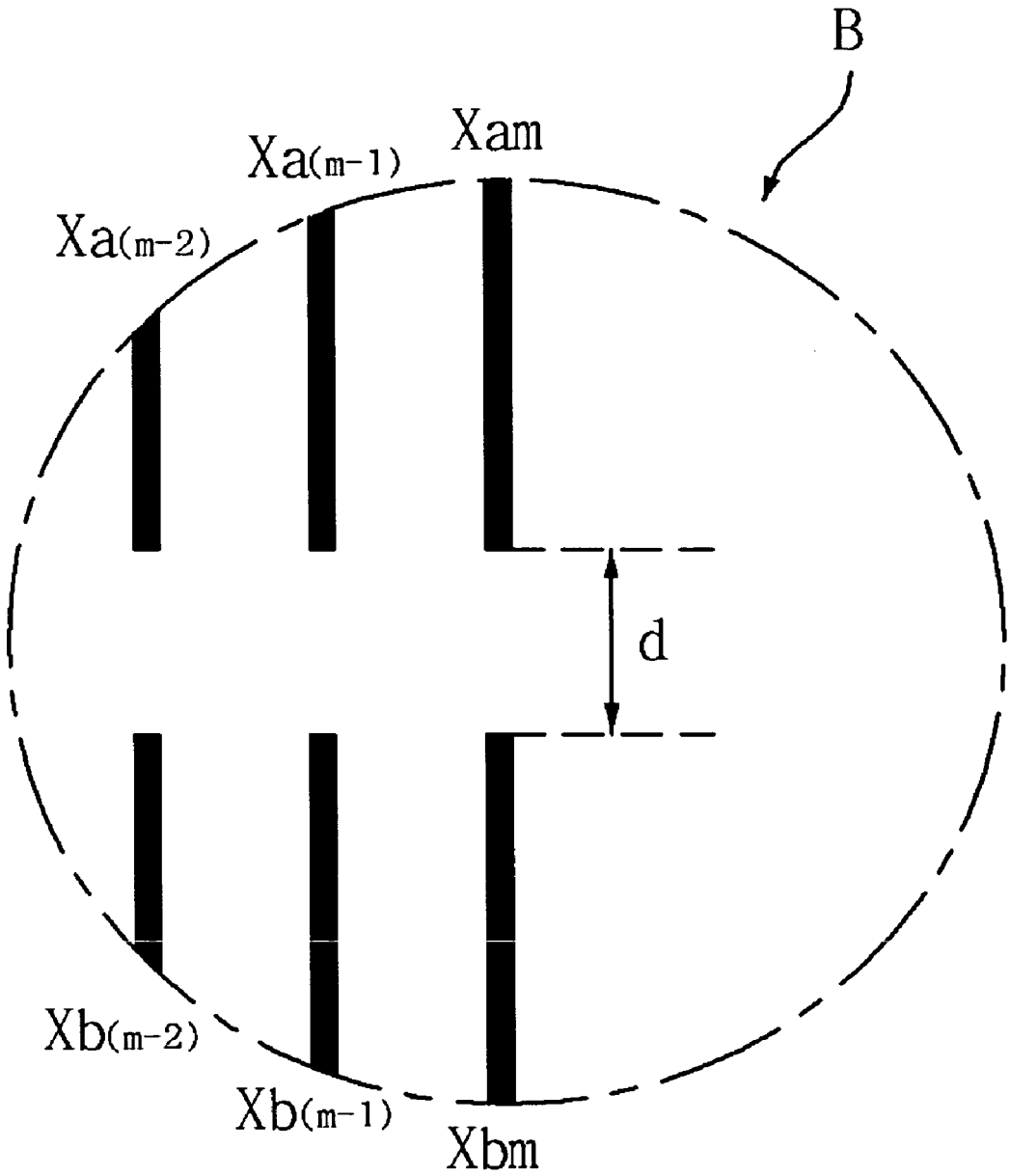

FIGS. 4*b* and 4*c* are views illustrating another structure of the address electrode of the plasma display panel applied to the plasma display apparatus according to an embodiment of the present invention.

Referring first to FIG. 4*b*, a plasma display panel 420 applied to the plasma display apparatus according to an embodiment of the present invention is divided into a first region 430 and a second region 440.

A plurality of first address electrodes Xa are disposed in parallel in the first region 430, and a plurality of second address electrodes Xb are also disposed in parallel in the second region 440. Furthermore, the plurality of second address electrodes Xb are disposed opposite to the first address electrodes Xa, respectively.

For example, in the case where a first address electrode Xa1 to a first address electrode Xam are disposed in parallel in the first region 430, a second address electrode Xb1 to a second address electrode Xbm corresponding to the first address electrode Xa1 to the first address electrode Xam, respectively, are disposed in parallel in the second region 440.

In this case, the first address electrode Xa1 and the second address electrode Xb1 are disposed opposite to each other and the first address electrode Xam and the second address electrode Xbm are disposed opposite to each other.

FIG. 4*c* illustrates, in detail, a region B in which the first address electrode Xa and the second address electrode Xb are opposite to each other.

Referring to FIG. 4*c*, a first address electrode Xa(m−2) and a second address electrode Xb(m−2), a first address electrode Xa(m−1) and a second address electrode Xb(m−1), a first address electrode Xam and a second address electrode Xb(m−2) are disposed opposite to each other with a distance "d" therebetween.

That is, the first address electrode Xa and the second address electrode Xb are opposite to each other with a distance "d" therebetween.

In this case, if the distance between the first address electrode Xa and the second address electrode Xb is too narrow, there is a possibility that a current may flow between the first address electrode Xa and the second address electrode Xb due to mutual coupling.

In contrast, if the distance between the first address electrode Xa and the second address electrode Xb is too wide, noise of a stripe shape may be seen on images displayed on the plasma display panel by means of the eyes of a viewer.

In view of the above, it is preferred that the distance "d" between the first address electrode Xa and the second address electrode Xb is set in the range of approximately from 50 μm to 300 μm.

More preferably, the distance "d" between the first address electrode Xa and the second address electrode Xb is set within a range of approximately from 70 μm to 220 μm.

As the address electrodes are divided into the first address electrode Xa and the second address electrode Xb as described above, the shape of the data driver for driving the first address electrode Xa and the second address electrode Xb can also be changed.

Now description will be made with reference to FIG. 3.

The driver 304 drives the plurality of electrodes in such a manner that a predetermined driving voltage is supplied to the plurality of electrodes formed in the plasma display panel 300 in one or more subfields comprised in one frame.

In this case, an exemplary structure of a frame for driving the plurality of electrodes of the plasma display panel 300 will be described in detail below with reference to FIG. 5.

Figure 5:
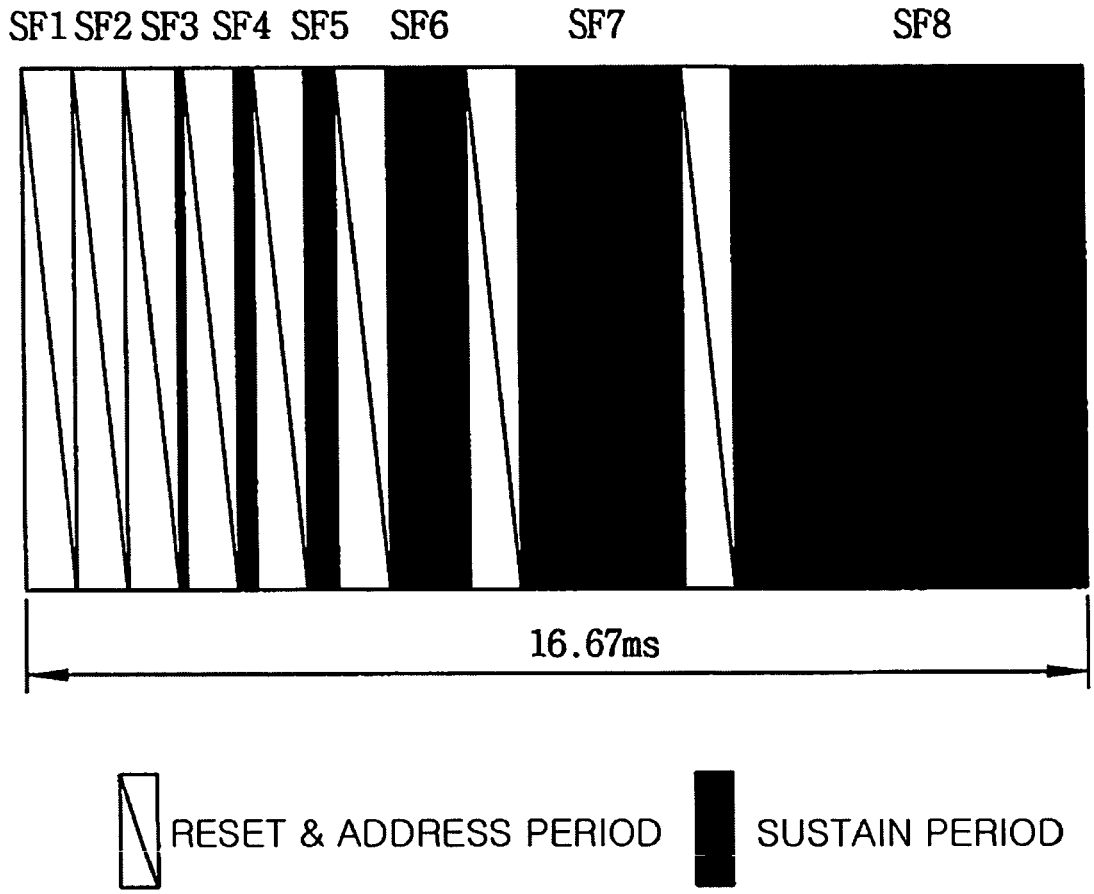
FIG. 5 is a view illustrating a frame for implementing gray levels of an image in the plasma display apparatus according to an embodiment of the present invention.

FIG. 5 is a view illustrating a frame for implementing gray levels of an image in the plasma display apparatus according to an embodiment of the present invention.

Referring to FIG. 5, in the plasma display apparatus of the present invention, a frame for implementing gray levels of an image is divided into several subfields with a different number of emissions.

Furthermore, though not shown in the drawing, each subfield is divided into a reset period RPD for initializing the entire discharge cells, an address period APD for selecting a discharge cell to be discharged, and a sustain period SPD for implementing gray levels depending on the discharge number.

For example, if it is sought to display images with 256 gray levels, a frame period (16.67 ms) corresponding to 1/60 seconds is divided into eight subfields SF1 to SF8 as shown in FIG. 5. Each of the eight subfields SF1 to SF8 is sub-divided into a reset period, an address period and a sustain period.

In this case, the reset period and the address period of each subfield are the same every subfield.

Furthermore, a data discharge for selecting a discharge cell to be discharged is generated due to the voltage difference between the address electrode X and the scan electrode Y.

The sustain period is a period for deciding a gray level weight in each subfield.

For example, a gray level weight of each subfield can be decided so that it is increased in the ratio of $2^n$ (where, n=0, 1, 2, 3, 4, 5, 6, 7) in such a manner that a gray level weight of a first subfield is set to $2^0$ and a gray level weight of a second subfield is set to 21. Gray levels of various images can be implemented by controlling the number of sustain signals supplied in the sustain period of each subfield depending on the gray level weight in the sustain period in each subfield as described above.

The plasma display apparatus according to an embodiment of the present invention uses a plurality of frames in order to display an image of 1 second. For example, 60 frames may be used to display an image of 1 second.

It has been shown in FIG. 5 that one frame comprises eight subfields. It is, however, to be understood that the number of subfields constituting one frame may be varied in various ways.

For example, twelve subfields from a first subfield to a twelfth subfield may form one frame and ten subfields may form one frame.

The picture quality of an image implemented by the plasma display apparatus that implement gray levels of an image using the frame may be decided depending on the number of subfields comprised in the frame.

In other words, when the number of subfields comprised in a frame is 12, gray levels of an image of $2^{12}$ kinds can be represented. When the number of subfields comprised in a frame is 8, gray levels of an image of $2^8$ kinds can be represented.

It has been shown in FIG. 5 that the subfields are arranged in order of increasing magnitudes of gray level weights in one frame. It is, however, to be understood that the subfields may be arranged in order of decreasing magnitudes of gray level weights in one frame or the subfields may be arranged regardless of gray level weights.

Now description about FIG. 3 will begin again.

The driver 304 for driving the plurality of electrodes of the plasma display panel 300 in one or more subfields of the frame as shown in FIG. 5 may have a different structure depending on electrodes formed in the plasma display panel 300.

In the case where a sustain electrode Z parallel to a scan electrode Y and a scan electrode Y is formed in the plasma display panel 300 and the address electrode X is formed to cross the scan electrode Y and the sustain electrode Z, the driver 304 may preferably comprise a data driver 301, a scan driver 302, and a sustain driver 303.

The operation of the driver 304 when the driver 304 comprises the data driver 301, the scan driver 302, as the sustain driver 303 as described above will be described below with reference to FIG. 6.

Figure 6:
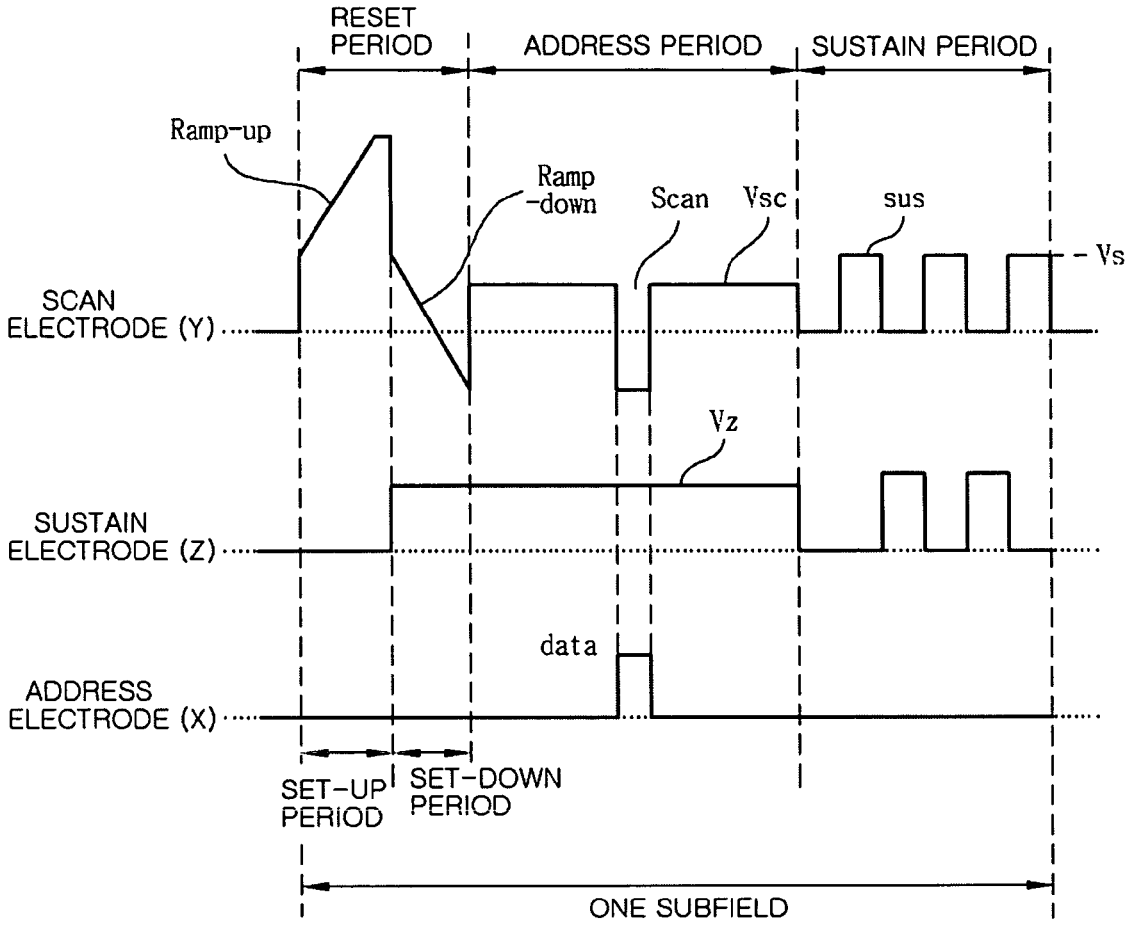
FIG. 6 is an operating timing diagram illustrating the operation of a driver comprising a data driver, a scan driver, and a sustain driver.

FIG. 6 is an operating timing diagram illustrating the operation of the driver comprising the data driver, the scan driver, and the sustain driver 이다.

Referring to FIG. 6, the driver 304 supplies a driving voltage to the address electrode X, the scan electrode Y, and the sustain electrode Z in the reset period, the address period, and the sustain period of one subfield.

The driver 304 supplies the scan electrode Y with a ramp-up signal Ramp-up in a set-up period of the reset period, as shown in FIG. 6. Preferably, the scan driver 302 of the driver 304 may supply the scan electrode Y with the ramp-up signal Ramp-up.

The ramp-up signal causes a weak dark discharge to be generated within the discharge cells of the whole screen. The set-up discharge causes positive wall charges to be accumulated on the address electrode X and the sustain electrode Z and also causes negative wall charges to be accumulated on the scan electrode Y.

Furthermore, after the ramp-up signal is supplied to the scan electrode Y, the driver 304 (preferably, the scan driver 302 of the driver 304) supplies a ramp-down signal Ramp-down, which falls from a positive voltage lower than a peak voltage of the ramp-up signal to a specific voltage level lower than a ground (GND) level voltage, to the scan electrode Y in a set-down period of the reset period, as shown in FIG. 6.

Accordingly, a weak erase discharge is generated within the discharge cells, whereby wall charges that have been excessively formed within the discharge cells are sufficiently erasing. The set-down discharge causes wall charges of the degree in which an address discharge can occur stably within the discharge cells uniformly.

The driver 302 (preferably, the scan driver 302 of the driver 304) supplies a negative scan signal Scan, which falls from a scan reference voltage Vsc, to the scan electrode Y in the address period, as shown in FIG. 6.

Furthermore, the driver 304 (preferably, the data driver 301 of the driver 304) supplies a positive data signal DATA to the address electrode X corresponding to the above-mentioned scan signal.

As the voltage difference between the scan signal and the data signal and a wall voltage generated in the reset period are added, the address discharge is generated within discharge cells to which the data signal is applied.

The address discharge causes wall charges of the degree in which a discharge can occur when a sustain voltage Vs is applied to be formed within selected discharge cells. Accordingly, the scan electrode Y is scanned.

In the sustain period subsequent to the address period, the driver 304 alternately supplies a sustain signal SUS to one or more of the scan electrode Y and the sustain electrode Z.

Preferably, the scan driver 302 and the sustain driver 303 of the driver 304 may alternately supply the sustain signal SUS to the scan electrode Y and the sustain electrode Z.

Accordingly, a sustain discharge (i.e., a display discharge) is generated between the scan electrode Y and the sustain electrode Z in discharge cells selected by the address discharge whenever the sustain signal is applied as the wall voltage within the discharge cell and the sustain signal are added.

In this case, the driver 304 for supplying the data signal to the address electrode X corresponding to the scan signal in the above-mentioned address period (i.e., the data driver 301) will be described in more detail below with reference to FIG. 7.

Figure 7:
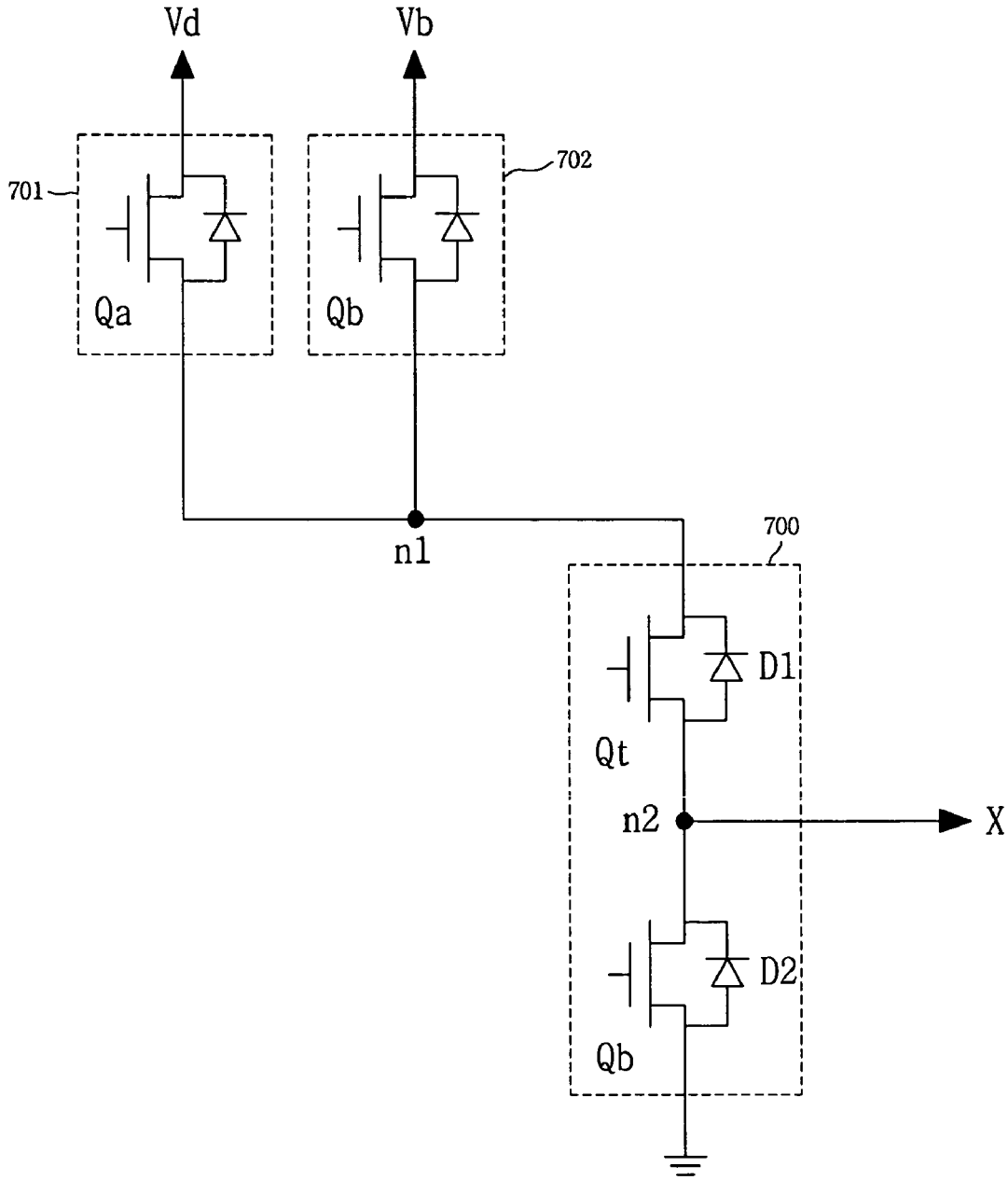
FIG. 7 is a detailed circuit diagram of a data driver of the plasma display apparatus according to an embodiment of the present invention.

FIG. 7 is a detailed circuit diagram of the data driver of the plasma display apparatus according to an embodiment of the present invention.

Referring to FIG. 7, the data driver of the plasma display apparatus according to an embodiment of the present invention comprises a data drive IC 700, a bias voltage supply control switch 702, Qb, and a data voltage supply control switch 701, Qa.

In this case, the bias voltage supply control switch 702 supplies the bias voltage Vb, which is supplied received a bias voltage source (not shown), to the data drive IC 700.

The bias voltage Vb supplied through the bias voltage supply control switch 702 has a voltage value that does not generate the address discharge in the address period.

In this case, it is preferred that the bias voltage Vb have a value, which is higher than that of the ground level GND and is lower than the voltage Vd of the data signal. In other words, the relationship $0V<Vb<Vd$ is established.

For example, in the case where the number of the bias voltage supply control switch 702 is one as in FIG. 7, it is more preferred that a magnitude of the bias voltage Vb supplied through the bias voltage supply control switch 702 approximately equals to half the voltage of the data signal the voltage Vd of the data signal.

The data voltage supply control switch 701 supplies the voltage Vd of the data signal, which is received from the data voltage source (not shown), to the data drive IC 700.

The data drive IC 700 is connected to the address electrode X of the plasma display panel and supplies a voltage supplied thereto to the address electrode X through predetermined switching.

The data drive IC 700 may be preferably formed in a single board separately from the data voltage supply control switch 701 and the bias voltage supply control switch 702.

For example, the data drive IC 700 may be preferably formed on a Tape Carrier Package (TCP) in a single chip form.

Furthermore, the data drive IC 700 may preferably comprise a top switch Qt and a bottom switch Qb.

In this case, one terminal of the top switch Qt is commonly connected to the data voltage supply control switch 701 and the bias voltage supply control switch Qb and the other terminal of the top switch Qt is connected to one terminal of the bottom switch Qb.

Furthermore, the other terminal of the bottom switch Qb is connected to the ground GND, and the address electrode X is connected to a second node n2 between the other terminal of the top switch Qt and one terminal of the bottom switch Qb.

In this case, the top switch Qt and the bottom switch Qb of the above-mentioned data drive IC 700 may preferably comprise a Field Effect Transistor (FET).

The reason why the FET is used as a switching element in the data drive IC 700 as described above is that it can reduce a total power consumption amount of the plasma display apparatus since the switching operation can be controlled even with a low voltage.

Furthermore, the FET equivalently comprises an internal diode. A internal diode D1 of the top switch Qt of the above-mentioned data drive IC 700 has a cathode commonly connected to the data voltage supply control switch 701 and the bias voltage supply control switch 702 and an anode connected to the bottom switch Qb.

Furthermore, an internal diode D2 of the bottom switch Qb of the data drive IC 700 has a cathode connected to the above-mentioned top switch Qt and an anode connected to the ground GND.

The operation of the plasma display apparatus shown in FIG. 7 according to an embodiment of the present invention will be described below with reference to FIGS. 8*a* and 8*b* and FIGS. 9*a* and 9*b*.

Figure 8A:
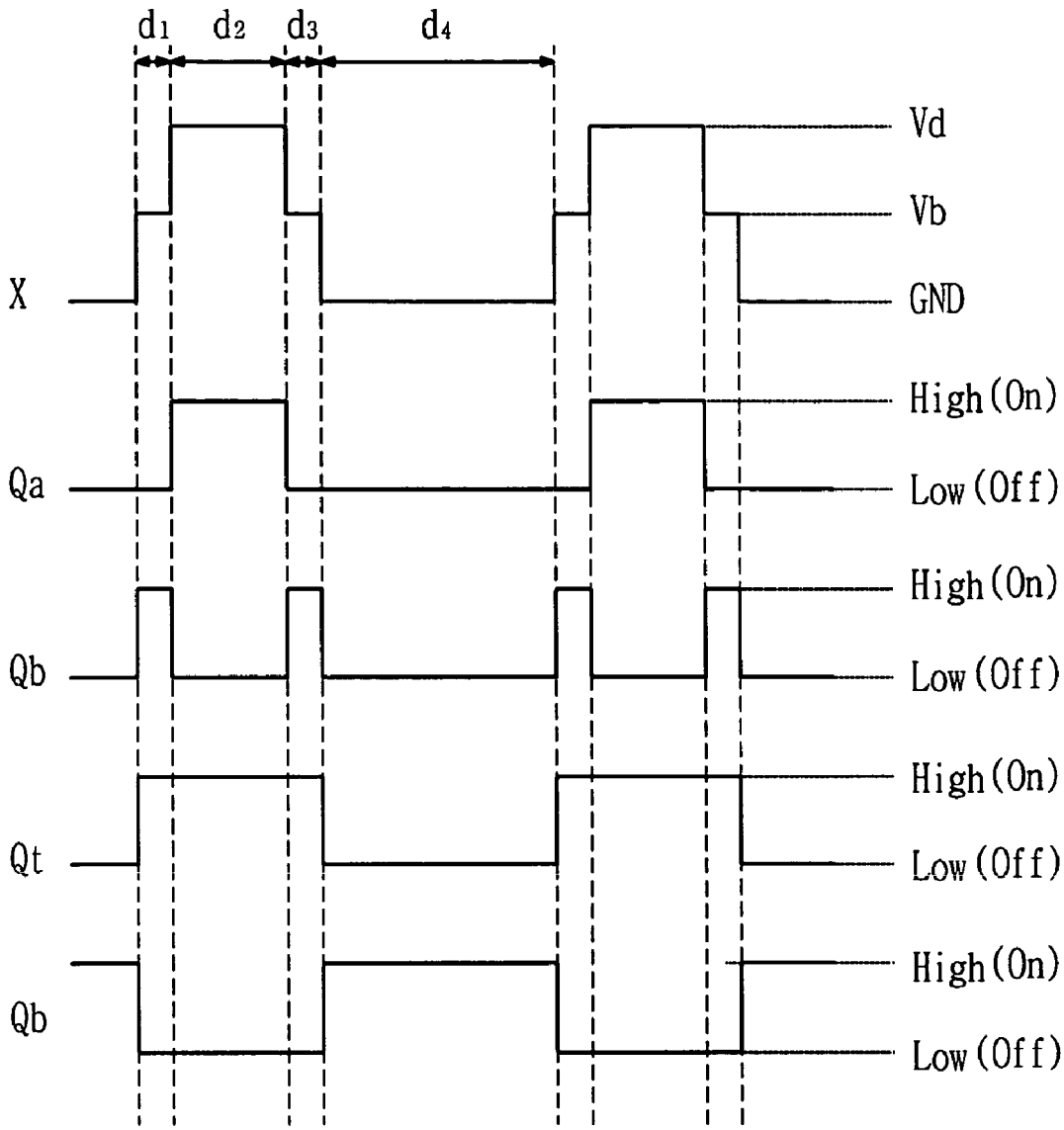
FIGS. 8*a* and 8*b* are operating timing diagrams illustrating the operation of the plasma display apparatus shown in FIG. 7 according to an embodiment of the present invention.
Figure 8B:
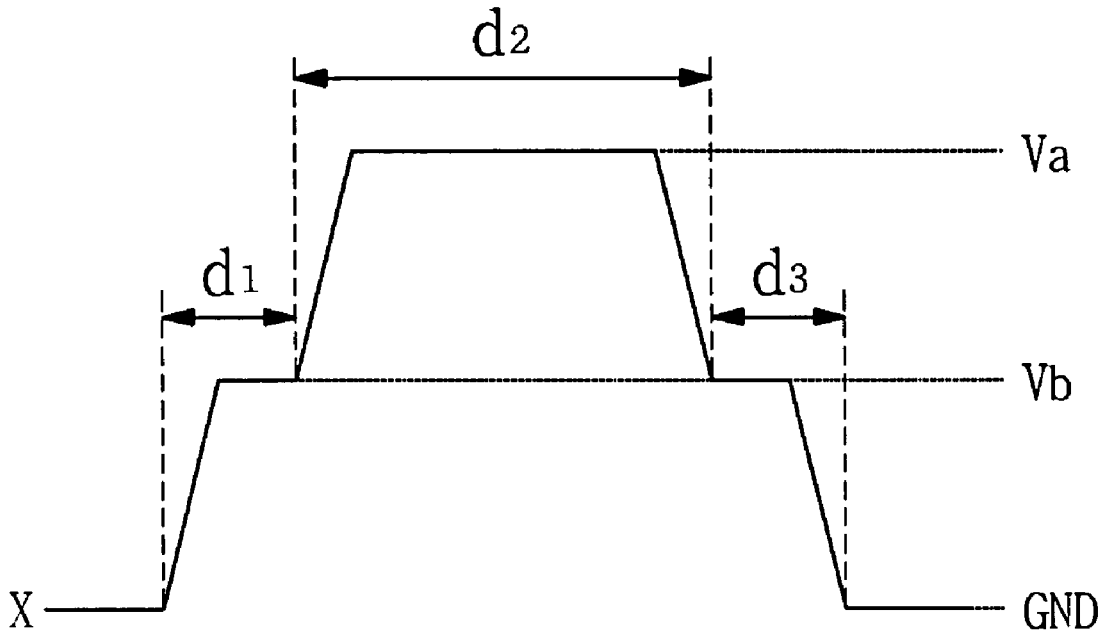

FIGS. 8*a* and 8*b* are operating timing diagrams illustrating the operation of the plasma display apparatus shown in FIG. 7 according to an embodiment of the present invention.

Figure 9A:
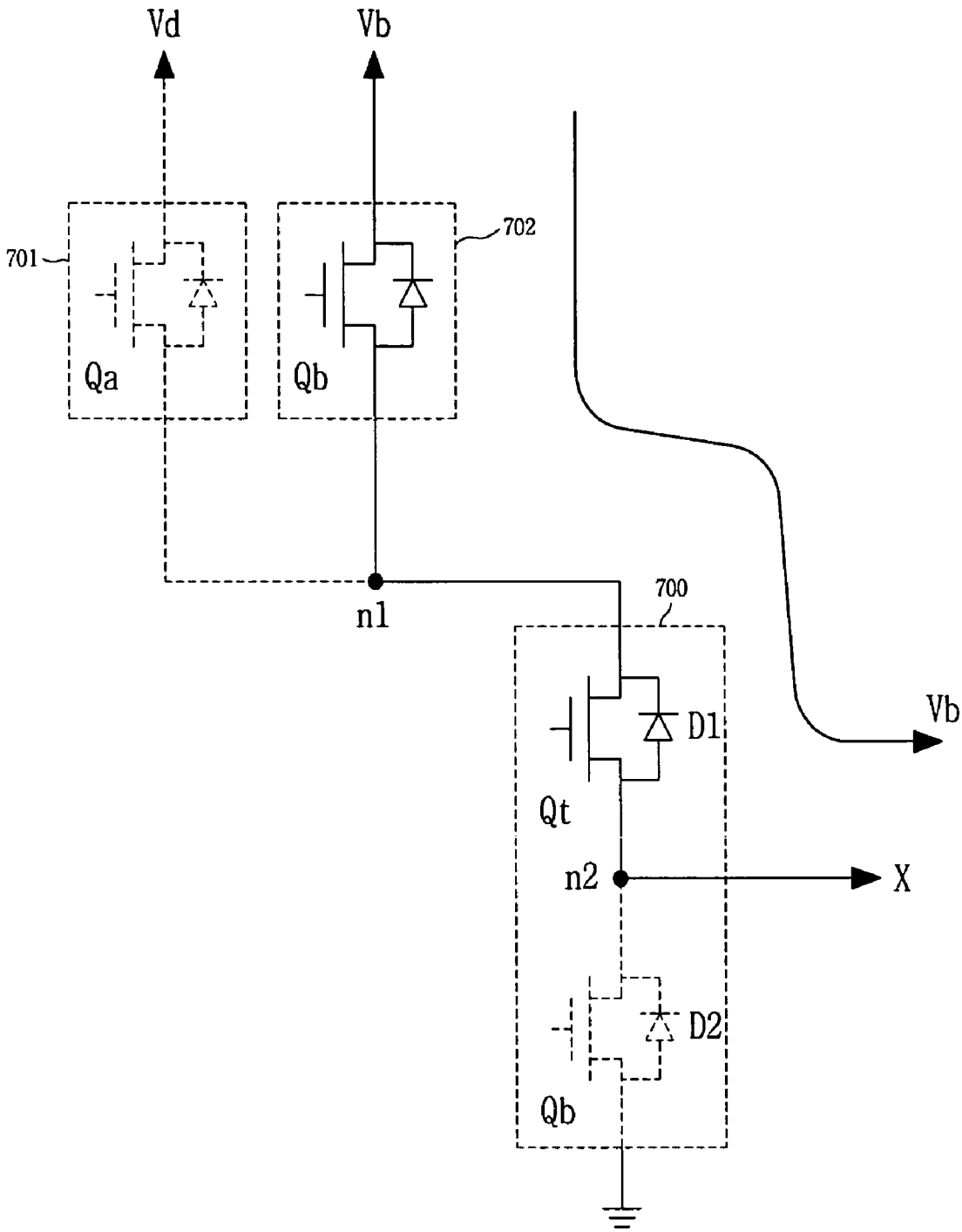
FIGS. 9*a*, 9*b* and 9*c* are circuit diagrams illustrating the process of supplying a bias voltage Vb and a data voltage Vd in the plasma display apparatus shown in FIG. 7 according to an embodiment of the present invention.
Figure 9B:
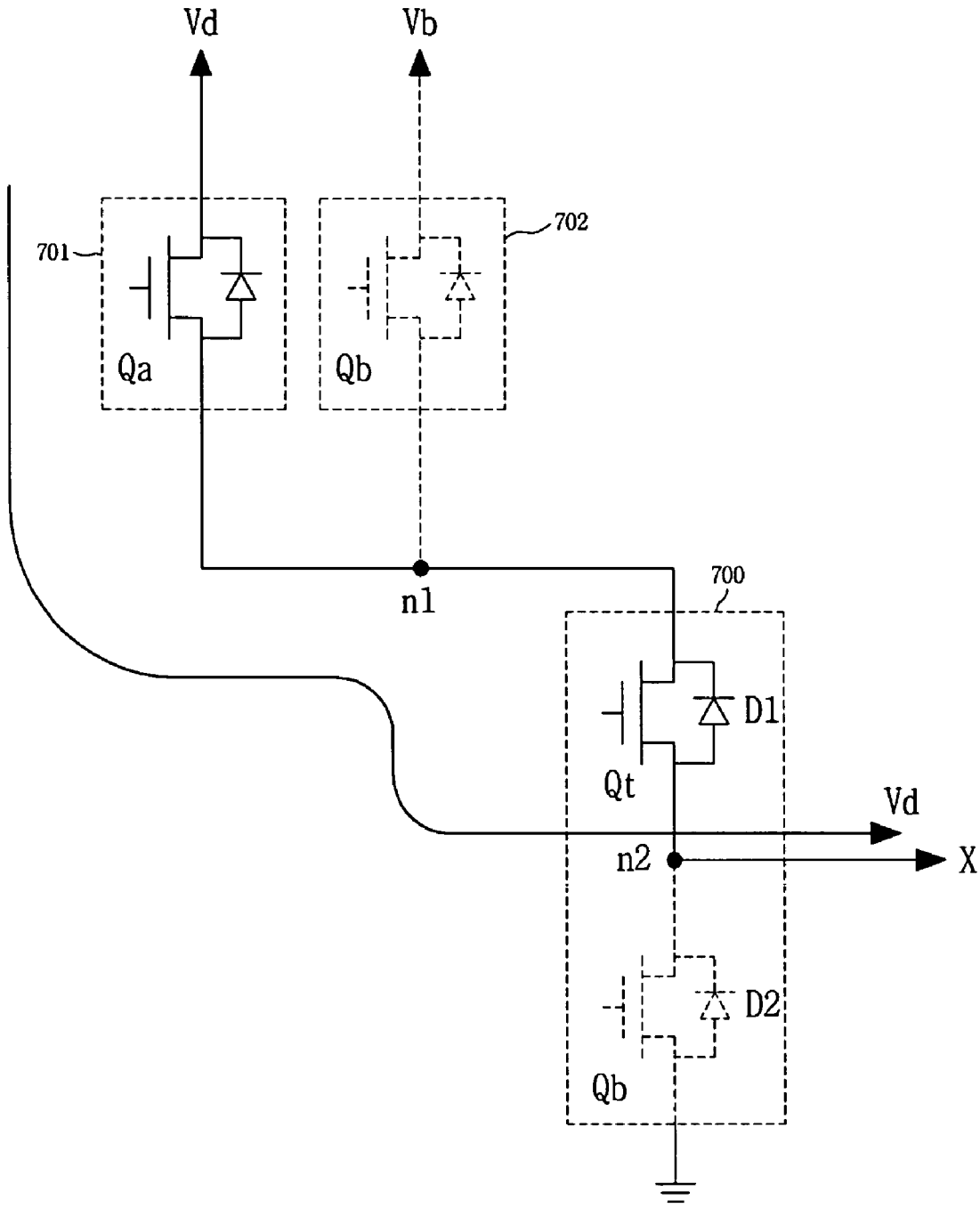

FIGS. 9*a* and 9*b* are circuit diagrams illustrating the process of supplying the bias voltage Vb and the data voltage Vd in the plasma display apparatus shown in FIG. 7 according to an embodiment of the present invention.

Referring first to FIG. 8*a*, if the top switch Qt of the data drive IC 700 is turned on, the bottom switch Qb of the data drive IC 700 is turned off, and the bias voltage supply control switch 702, Qb is turned in FIG. 7 in the address period, the bias voltage Vb generated from the bias voltage source (not shown) is supplied to the address electrode X through the first node n1 to the top switch Qt and the second node n2 of the above-mentioned data drive IC 700.

Accordingly, as shown in a period d1 of FIG. 8*a*, a voltage of the address electrode X rises up to the bias voltage Vb.

The voltage supply path of the bias voltage Vb in the period d1 is shown in FIG. 9*a*.

Referring to FIG. 9*a*, in the period d1, the bias voltage Vb is supplied from the bias voltage source (not shown) to the address electrode X through the bias voltage supply control switch 702, Qb and the top switch Qt of the data drive IC 700.

In this case, a magnitude of the bias voltage Vb is preferably higher than a voltage of the ground level GND and is lower than the voltage Vd of the data signal. Accordingly, an address discharge is not generated in the period d1.

Thereafter, if the bias voltage supply control switch 702, Qb is turned off and the data voltage supply control switch 701, Qa is turned on in a state where the top switch Qt of the data drive IC 700 is turned on and the bottom switch Qb of the data drive IC 700 is turned off, the voltage Vd of the data signal from the data voltage source (not shown) is supplied to the address electrode X through the first node n1 to the top switch Qt and the second node n2 of the above-mentioned data drive IC 700.

Accordingly, as in a period d2 of FIG. 8*a*, a voltage of the address electrode X rises from the bias voltage Vb to the voltage Vd of the data signal.

The voltage supply path of the voltage Vd of the data signal in the period d2 is shown in FIG. 9*b*.

Referring to FIG. 9*b*, in the period d2, the voltage Vd of the data signal is supplied from the data voltage source (not shown) to the address electrode X through the data voltage supply control switch 701, Qa and the top switch Qt of the data drive IC 700.

In this case, an address discharge is generated in the period d2 by means of a difference between the voltage Vd of the data signal and a voltage of the scan signal supplied to the scan electrode Y. Accordingly, the scanning of the scan electrode Y is performed.

Thereafter, if the bias voltage supply control switch 702, Qb is turned on and the data voltage supply control switch 701, Qa is turned on in a state where the top switch Qt of the data drive IC 700 is turned on and the bottom switch Qb of the data drive IC 700 is turned off, the bias voltage Vb is supplied from the bias voltage source (not shown) to the address electrode X through the top switch Qt of the above-mentioned data drive IC 700.

Therefore, as in a period d3 of FIG. 8*a*, a voltage of the address electrode X falls from the voltage Vd of the data signal to the bias voltage Vb.

The voltage supply path of the bias voltage Vb in the period d3 is the same as that shown in FIG. 9*a*.

In this case, a magnitude of the bias voltage Vb is preferably higher that a voltage of the ground level GND and is lower than the voltage Vd of the data signal. Accordingly, the address discharge is not generated in the period d3.

Thereafter, if the top switch Qt of the data drive IC 700 is turned off and the bottom switch Qb of the data drive IC 700 is turned on, a voltage of the ground level GND is supplied from the base voltage source (not shown) to the address electrode X through the bottom switch Qb of the above-mentioned data drive IC 700.

Accordingly, as in a period d4 of FIG. 8*a*, a voltage of the address electrode X falls from the bias voltage Vb to a voltage of the ground level GND.

Figure 9C:
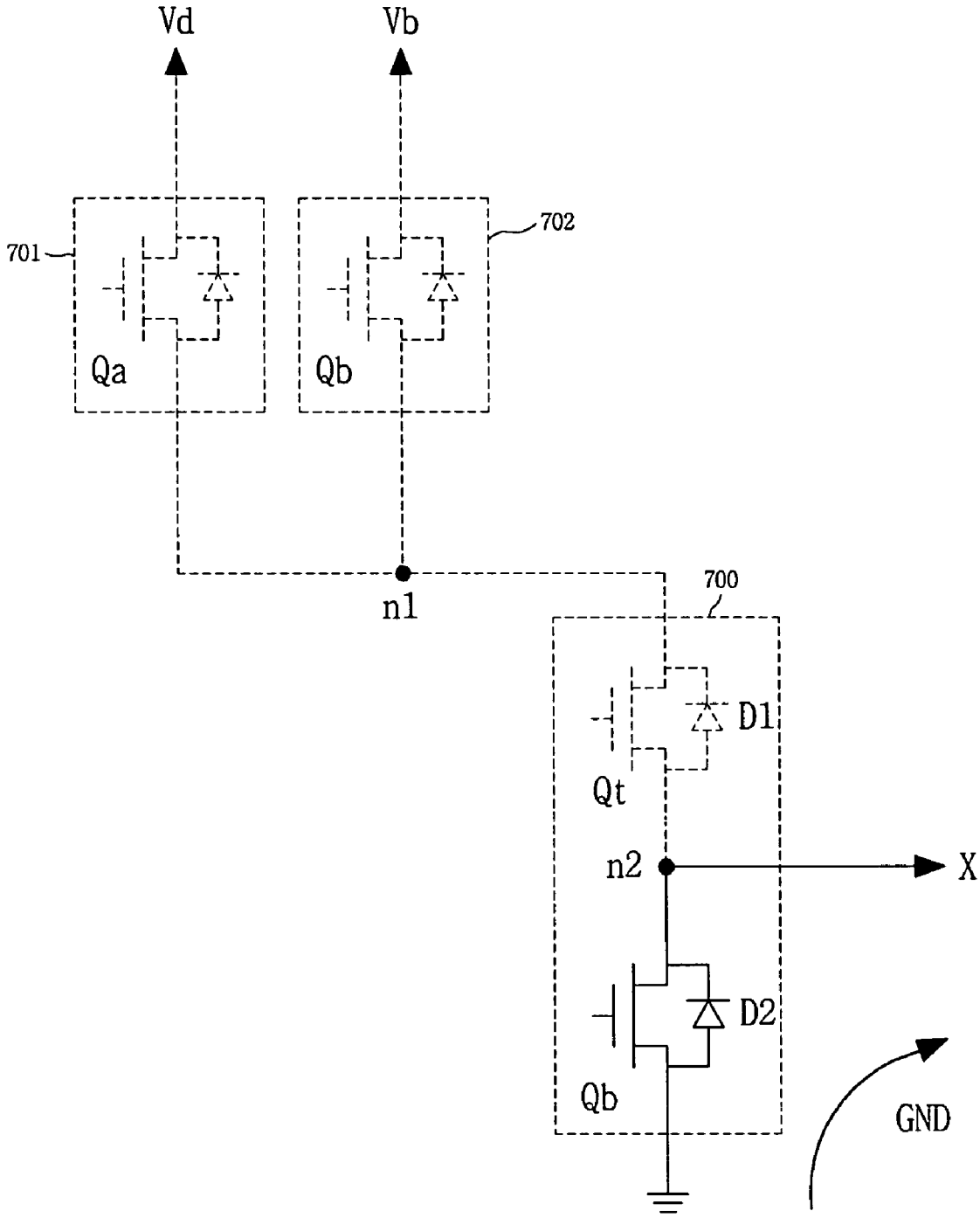

The voltage supply path of the voltage of the ground level GND in the period d4 is shown in FIG. 9*c*.

Referring to FIG. 9*c*, in the period d4, the voltage of the ground level GND is supplied from the base voltage source (not shown) to the address electrode X through the bottom switch Qb of the data drive IC 700.

In the plasma display apparatus operating as described above according to an embodiment of the present invention, the switching elements used in the data drive ICs as shown in FIG. 7 (i.e., the top switch Qt and the bottom switch Qb) may have a withstanding voltage characteristic that is relatively smaller than that in the related art as shown in FIG. 1.

For example, it is assumed that a magnitude of the voltage Vd of the data signal supplied by the data voltage source (not shown) is 60V and a magnitude of the bias voltage supplied by the bias voltage source (not shown) is 30V, which approximately equals to half the voltage of the data signal the voltage Vd of the data signal.

It is also assumed that an equivalent resistance value of the top switch Qt of the data drive IC 700 is R1, an equivalent resistance value of the data voltage supply control switch 701, Qa is R2, and an equivalent resistance value of the bias voltage supply control switch 702, Qb is R3.

In this case, when the bias voltage Vb is supplied to the address electrode X through the data drive IC (reference numeral 700 in FIG. 7), a current flowing through the top switch Qt1 and a magnitude consumed in the top switch Qt1 can be expressed in the following equation 2.

$$ia=30\text{V}/(R1+R3)$$

$$Wa=ia\times 30\text{V} \qquad \text{[Equation 2]}$$

Here "ia" denotes a magnitude of a current flowing through the top switch Qt of the data drive IC 700 when the bias voltage Vb is supplied to the address electrode X and "Wa" denotes a magnitude of power consumed in the top switch Qt at this time.

From Equation 2, it can be seen that the top switch Qt of the data drive IC 700 consumes power of Wa (i.e., ia×30V) when the bias voltage Vb is supplied. At this time, heat is generated from the top switch Qt in proportion to the consumption power Wa.

For example, assuming that the resistance value R1 of the top switch Qt is 30Ω (ohm), which is the same as that of the top switch Qt1 in FIG. 1 and an equivalent resistance R3 of the bias voltage supply control switch 702, Qb is also 30Ω (ohm), heat as much as (30/60)×30=15 W is generated from the top switch Qt.

Furthermore, when the voltage Vd of the data signal is supplied from the bias voltage Vb to the address electrode X through the data drive IC (reference numeral 700 in FIG. 7), a current flowing through the top switch Qt1 and a magnitude consumed at the top switch Qt1 can be expressed in the following equation 3.

$$ib=(60-30)\text{V}/(R1+R2)$$

$$Wb=ib\times(60-30\text{V}) \qquad \text{[Equation 3]}$$

Here "ib" denotes a magnitude of a current flowing through the top switch Qt of the data drive IC 700 when the voltage Vd of the data signal is supplied from the bias voltage Vb to the address electrode X and "Wa" denotes a magnitude of power consumed at the top switch Qt at this time.

Referring to Equation 3, when the voltage Vd of the data signal, which is assumed to be 60V is supplied, a magnitude of a voltage applied to the top switch Qt of the data drive IC 700 is 30V.

This is because as the bias voltage Vb is supplied before the voltage Vd of the data signal is supplied, a shift amount of a voltage in the top switch Qt of the data drive IC 700 is 30V.

Accordingly, it can be seen that the top switch Qt of the above-mentioned data drive IC 700 consumes power Wb (i.e., ib×30V) when the voltage Vd of the data signal is supplied. At this time, heat is generated from the top switch Qt in proportion to the consumption power Wb.

For example, assuming that the resistance value R1 of the top switch Qt is 30Ω (ohm), which is the same as that of the top switch Qt1 in FIG. 1 and an equivalent resistance R2 of the data voltage supply control switch 701, Qa is also 30Ω (ohm), heat as much as (30/60)×30=15 W is generated from the top switch Qt.

In summary, a magnitude of heat generated from the top switch Qt of the data drive IC 700 is proportion to the sum of 15 W when the bias voltage Vb is supplied and 15 W when the voltage Vd of the data signal is supplied.

In other words, heat is generated from the top switch Qt of the data drive IC 700 in proportion to power consumption of 30 W in total upon driving.

As a result, in the plasma display apparatus of the present invention, an amount of heat generated from the top switch Qt of one data drive IC is about ¼ of that of the related art as shown in FIG. 1.

Only the top switch Qt of the data drive IC 700 has been described above. However, the operation of the bottom switch Qb is similar to that of the above-mentioned top switch Qt. Accordingly, it can be sufficiently considered that an amount of heat generated when the bottom switch Qb is driven is also reduced compared with the related art.

Therefore, in the plasma display apparatus according to an embodiment of the present invention, stable driving can be realized although switching elements with a relatively low withstanding voltage characteristic are used.

Furthermore, since an amount of heat generated when the plasma display apparatus according to an embodiment of the present invention is driven is reduced, thermal and electrical damage on the switching elements used in the plasma display apparatus according to an embodiment of the present invention can be prevented.

Meanwhile, it has been described with reference to FIG. 8*a* that when the voltage of the data signal rises from the voltage of the ground level GND to the bias voltage Vb and rises from the bias voltage Vb to the voltage Vd of the data signal, the voltage of the data signal abruptly rises. It is, however, to be noted that this is for convenience of drawing and description.

In the case where the voltage of the data signal rises from the voltage of the ground level GND to the bias voltage Vb and rises from the bias voltage Vb to the voltage Vd of the data signal, it preferably gradually rises with a slant. This is shown in FIG. 8*b*.

There is shown in FIG. 8*a* that the voltage of the data signal abruptly rises from the ground level GND to the bias voltage Vb and is then kept to the bias voltage Vb in the period d1.

In the period d1 of FIG. 8*b*, however, the voltage of the data signal gradually rises from the ground level GND to the bias voltage Vb with a slant and the voltage of the data signal is kept to the bias voltage Vb for a predetermined time.

There is also shown in FIG. 8*a* that in the period d2, the voltage of the data signal abruptly rises from the bias voltage Vb to the voltage Vd of the data signal and is then kept to the voltage Vd of the data signal.

In the period d2 of FIG. 8*b*, however, the voltage of the data signal gradually rises from the bias voltage Vb to the voltage Vd of the data signal with a slant, and the voltage of the data signal is kept to the voltage Vd of the data signal for a predetermined time and then gradually falls from the voltage Vd of the data signal to the bias voltage Vb with a slant.

Furthermore, there is shown in FIG. 8*a* that in the period d3, the voltage of the data signal is kept to the bias voltage Vb and then abruptly falls from the bias voltage Vb to the ground level GND.

In the period d3 of FIG. 8*b*, however, the voltage of the data signal is kept to the bias voltage Vb for a predetermined time and then gradually fall from the bias voltage Vb to the voltage of the ground level GND with a slant.

Meanwhile, in the plasma display apparatus shown in FIG. 7 according to an embodiment of the present invention, a reverse blocking unit may be further comprised in order to reduce a total switching number of the switching elements. Such a structure will be described below with reference to FIGS. 10*a* and 10*b*.

Figure 10A:
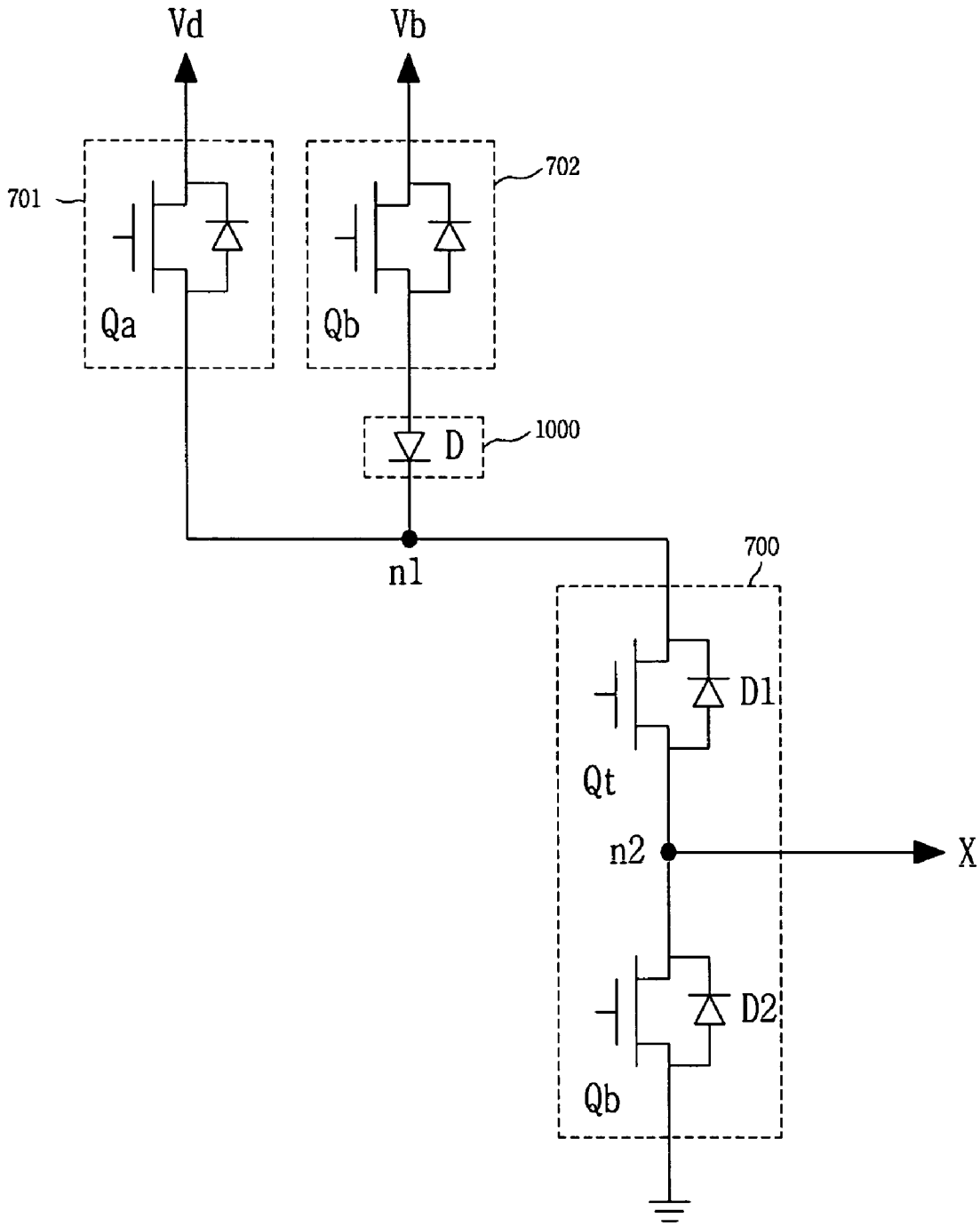
FIGS. 10*a* and 10*b* are circuit diagrams of a plasma display apparatus that further comprises a reverse blocking unit according to an embodiment of the present invention.
Figure 10B:
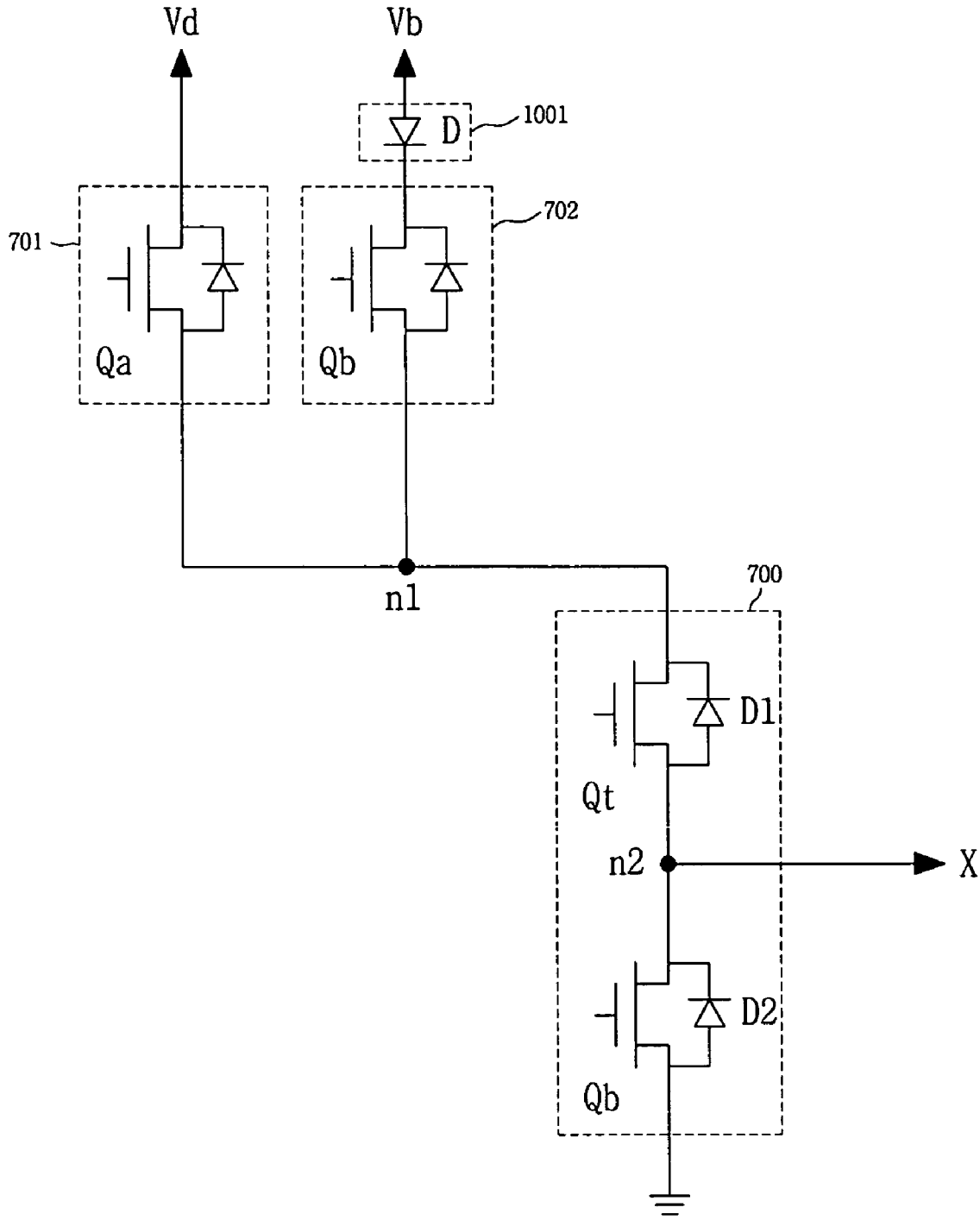

FIGS. 10*a* and 10*b* are circuit diagrams of a plasma display apparatus that further comprises a reverse blocking unit according to an embodiment of the present invention.

Referring to FIG. 10*a*, a reverse blocking unit 1000 is further comprised between the first node n1 between the data voltage supply control switch 701, Qa and the data drive IC 700, and the bias voltage supply control switch 702, Qb in the plasma display apparatus shown in FIG. 7 according to an embodiment of the present invention.

The reverse blocking unit 1000 blocks an inverse current that flows from the first node n1 to a bias voltage source (not shown) through the bias voltage supply control switch 702, Qb.

The reverse blocking unit 1000 may preferably comprise a reverse blocking diode D.

The reverse blocking diode D of the reverse blocking unit 1000 has an anode connected to the bias voltage supply control switch 702, Qb and a cathode connected to the first node n1.

In other words, the anode of the reverse blocking diode D of the reverse blocking unit 1000 is disposed in a direction of the bias voltage source (not shown).

Unlike FIG. 10*a*, the location of the reverse blocking unit 1000 may be changed, which is shown in FIG. 10*b*.

Referring to FIG. 10*b*, in the plasma display apparatus shown in FIG. 7 according to an embodiment of the present invention, a reverse blocking unit 1001 is further disposed between the bias voltage supply control switch 702, Qb and a bias voltage source (not shown).

The reverse blocking unit 1001 shown in FIG. 10*b* blocks an inverse current that flows from the first node n1 to the bias voltage source (not shown) through the bias voltage supply control switch 702, Qb in the same manner as the reverse blocking unit 1000 shown in FIG. 10*a*.

The reverse blocking unit 1001 comprises a reverse blocking diode D. Furthermore, the reverse blocking diode D of the reverse blocking unit 1001 has a cathode connected to the bias voltage supply control switch 702, Qb and an anode connected to the bias voltage source (not shown).

In other words, the anode of the reverse blocking diode D of the reverse blocking unit 1001 is disposed in a direction of the bias voltage source (not shown).

The operation of the plasma display apparatus as shown in FIGS. 10*a* and 10*b* according to an embodiment of the present invention will be described below with reference to FIG. 11.

Figure 11:
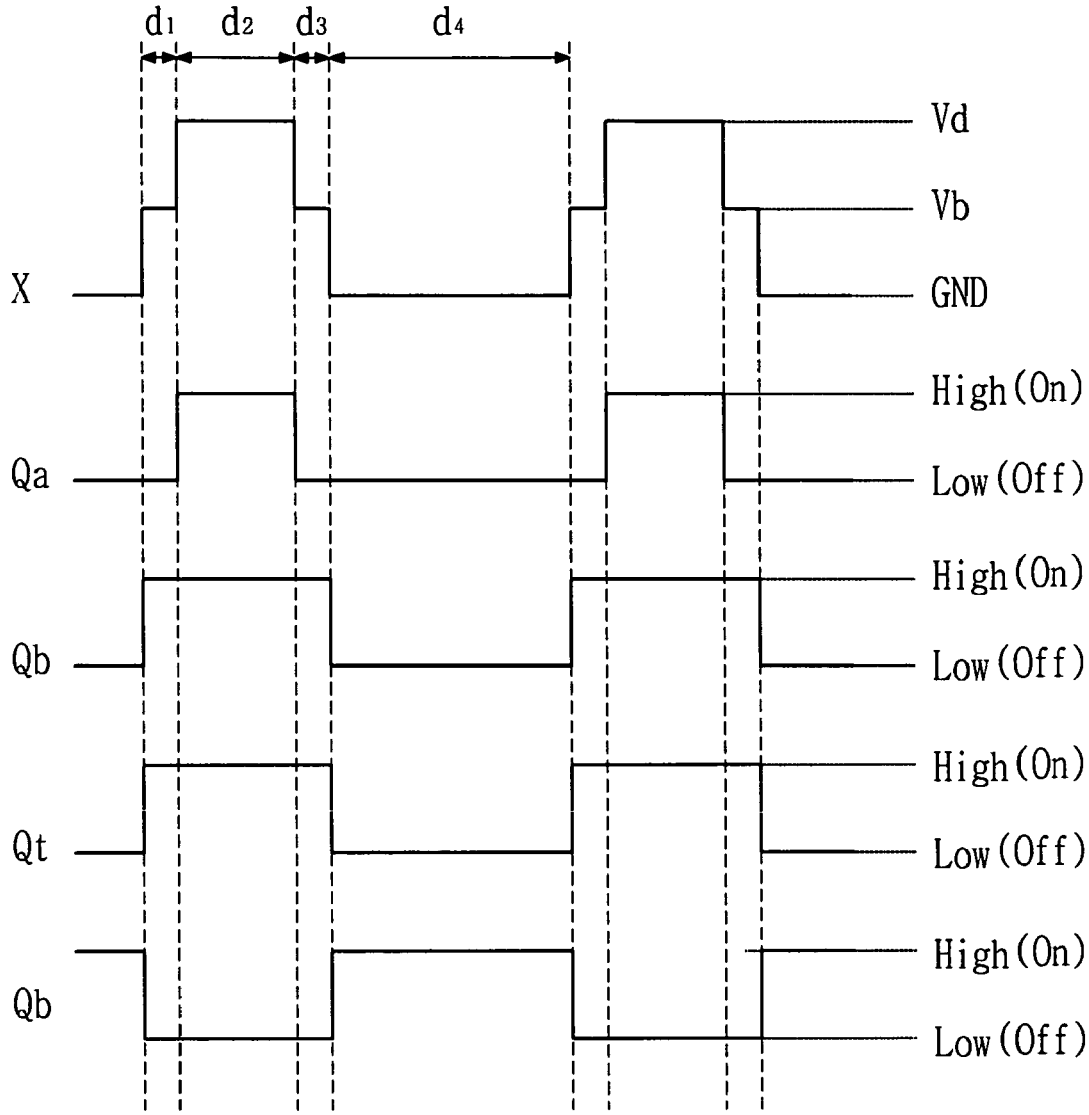
FIG. 11 is an operating timing diagram illustrating the operation of the plasma display apparatus shown in FIGS. 10*a* and 10*b* according to an embodiment of the present invention.

FIG. 11 is an operating timing diagram illustrating the operation of the plasma display apparatus shown in FIGS. 10*a* and 10*b* according to an embodiment of the present invention.

Referring to FIG. 11, if the top switch Qt of the data drive IC 700 is turned on, the bottom switch Qb of the data drive IC 700 is turned off, and the bias voltage supply control switch 702, Qb is turned in FIGS. 10*a* and 10*b* in the address period, the bias voltage Vb generated from the bias voltage source (not shown) is supplied to the address electrode X through the first node n1 to the top switch Qt and the second node n2 of the above-mentioned data drive IC 700.

Therefore, as in a period d1 of FIG. 11, a voltage of the address electrode X rises to the bias voltage Vb.

The voltage supply path of the bias voltage Vb in the period d1 is the same as those of FIG. 9*a*, and description thereof will be omitted for simplicity.

Thereafter, if the bias voltage supply control switch 702, Qb keeps turned on and the data voltage supply control switch 701, Qa is turned on in a state where the top switch Qt of the data drive IC 700 is turned on and the bottom switch Qb of the data drive IC 700 is turned off, the voltage Vd of the data signal is supplied from the data voltage source (not shown) to the address electrode X through the first node n1 to the top switch Qt and the second node n2 of the above-mentioned data drive IC 700.

Accordingly, as in a period d2 of FIG. 11, a voltage of the address electrode X rises from the bias voltage Vb to the voltage Vd of the data signal.

The voltage supply path of the voltage Vd of the data signal in the period d2 is the same as those of FIG. 9*b*, and description thereof will be omitted for simplicity.

In the period d2, if the data voltage supply control switch 701, Qa is turned on with the bias voltage supply control switch 702, Qb being turned on, an inverse current can flow from the data voltage supply control switch 701, Qa to the bias voltage supply control switch 702, Qb because the bias voltage Vb has a voltage level lower than that of the voltage Vd of the data signal.

If the reverse blocking unit 1000, 1001 is further comprised as in FIGS. 10*a* and 10*b*, however, the inverse current does not flow from the data voltage supply control switch 701, Qa to the bias voltage supply control switch 702, Qb. Accordingly, in the period d2, a normal operation is possible although the data voltage supply control switch 701, Qa is turned on with the bias voltage supply control switch 702, Qb being turned on.

A subsequent operation is the same as that of the plasma display apparatus shown in FIG. 7 according to an embodiment of the present invention, and description thereof will be omitted for simplicity.

In the above, an example in which only one data drive IC 700 is connected to the data voltage supply control switch 701, Qa and the bias voltage supply control switch 702, Qb has been shown and described.

Unlike the above, however, a plurality of data drive ICs 700 may be connected to the data voltage supply control switch 701, Qa and the bias voltage supply control switch 702, Qb. Such an example will be described below with reference to FIG. 12.

Figure 12:
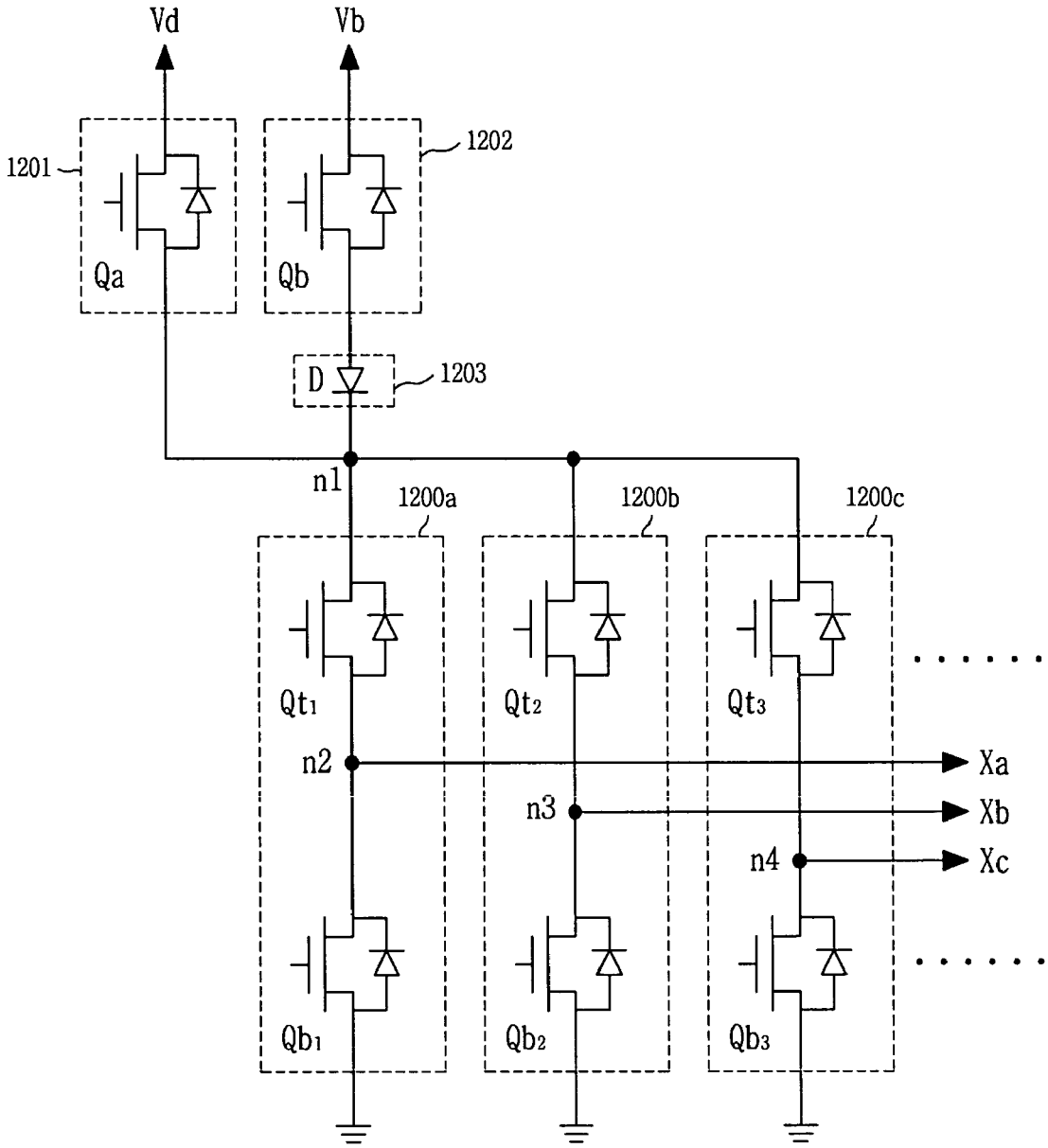
FIG. 12 is a circuit diagram illustrating another structure of the data driver of the plasma display apparatus according to an embodiment of the present invention.

FIG. 12 is a circuit diagram illustrating another structure of the data driver of the plasma display apparatus according to an embodiment of the present invention.

Referring to FIG. 12, the data driver of the plasma display apparatus according to an embodiment of the present invention comprises a plurality of data drive ICs 1200*a*, 1200*b*, and 1200*c*, a bias voltage supply control switch 1202, Qb, and a data voltage supply control switch 1201, Qa.

The bias voltage supply control switch 1202, Qb, and the data voltage supply control switch 1201, Qa of FIG. 12 have the same construction as that of the data voltage supply control switch 701, Qa and the bias voltage supply control switch 702, Qb of FIG. 7, and description thereof will be omitted for simplicity.

The plurality of data drive ICs 1200*a*, 1200*b*, and 1200*c* are connected to address electrodes X of the plasma display panel, respectively.

For example, a data drive IC (reference numeral "1200*a*") may be connected to an address electrode Xa at a second node n2, a data drive IC (reference numeral "1200*b*") may be connected to an address electrode Xb at a third node n3, and a data drive IC (reference numeral "1200*c*") may be connected to an address electrode Xc at a fourth node n4.

Furthermore, the plurality of data drive ICs 1200*a*, 1200*b*, and 1200*c* supply voltages supplied thereto to the address electrodes X, respectively, through predetermined switching.

The plurality of data drive ICs 1200*a*, 1200*b*, and 1200*c* may be preferably formed as a single module independently from the data voltage supply control switch 1201, Qa and the bias voltage supply control switch 702, Qb.

For example, a data drive IC (reference numeral "1200*a*"), a data drive IC (reference numeral "1200*b*"), and a data drive IC (reference numeral "1200*c*") may be formed on a single chip.

The operation of the plasma display apparatus shown in FIG. 12 according to an embodiment of the present invention will be described below with reference to FIG. 13.

Figure 13:
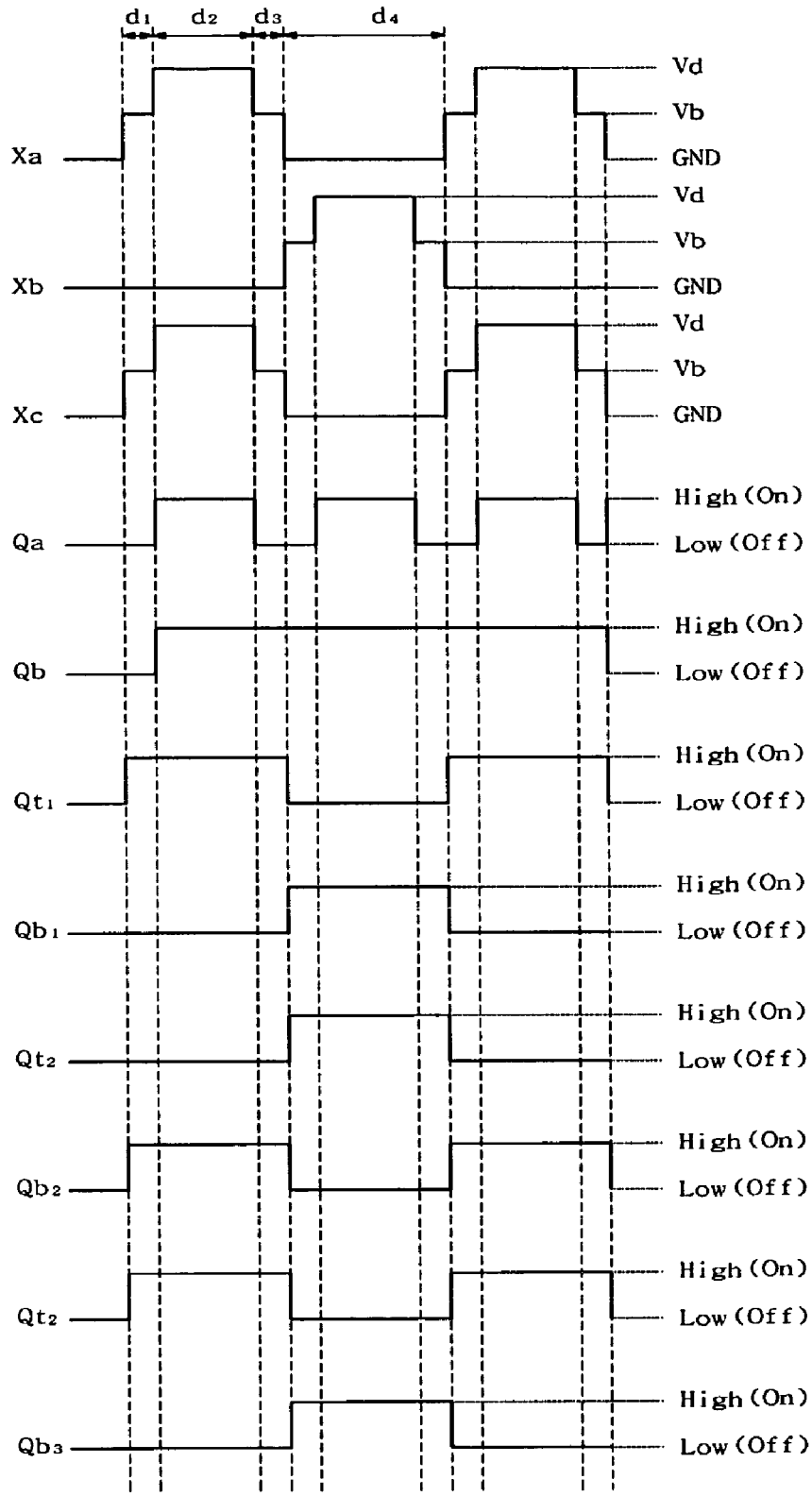
FIG. 13 is an operating timing diagram illustrating the operation of the plasma display apparatus shown in FIG. 12 according to an embodiment of the present invention.

FIG. 13 is an operating timing diagram illustrating the operation of the plasma display apparatus shown in FIG. 12 according to an embodiment of the present invention.

Referring to FIG. 13, the bias voltage supply control switch 1202, Qb connected to the plurality of data drive ICs 1200*a*, 1200*b*, and 1200*c* is turned on while at least one of the plurality of data drive ICs 1200*a*, 1200*b*, and 1200*c* supplies the bias voltage Vb or the voltage Vd of the data signal to the address electrode X.

For example, the bias voltage supply control switch 1202, Qb may be turned on when the data drive IC (reference numeral "1200*a*") supplies an address electrode Xa with the bias voltage Vb or the voltage Vd of the data signal.

Furthermore, the bias voltage supply control switch 1202, Qb may be turned on when the data drive IC (reference numeral "1200*b*") supplies an address electrode Xb with the bias voltage Vb or the voltage Vd of the data signal. Furthermore, the bias voltage supply control switch 1202, Qb may be turned on when the data drive IC (reference numeral "1200*c*") supplies an address electrode Xc with the bias voltage Vb or the voltage Vd of the data signal.

If the data drive IC (reference numeral "1200*a*"), the data drive IC (reference numeral "1200*b*"), and the data drive IC (reference numeral "1200*c*") do not supply the bias voltage Vb and the voltage Vd of the data signal to corresponding address electrodes X, for example, if a top switch Qt1 of the data drive IC (reference numeral "1200*a*"), a top switch Qt2 of the data drive IC (reference numeral "1200*b*"), and a top switch Qt3 of the data drive IC (reference numeral "1200*c*") are all turned off in FIG. 12, the bias voltage supply control switch 1202, Qb may be turned off.

Subsequent operations are the same as those described with reference to FIGS. 10*a* and 10*b* and FIG. 11, and description thereof will be omitted for simplicity.

In the above description about the plasma display apparatus according to an embodiment of the present invention, an example in which the number of the bias voltage supply control switch is only one has been taken.

In the plasma display apparatus according to an embodiment of the present invention, however, the number of the bias voltage supply control switches may be plural. An example in which the number of the bias voltage supply control switches is two, for example, will be described below with reference to FIG. 14.

Figure 14:
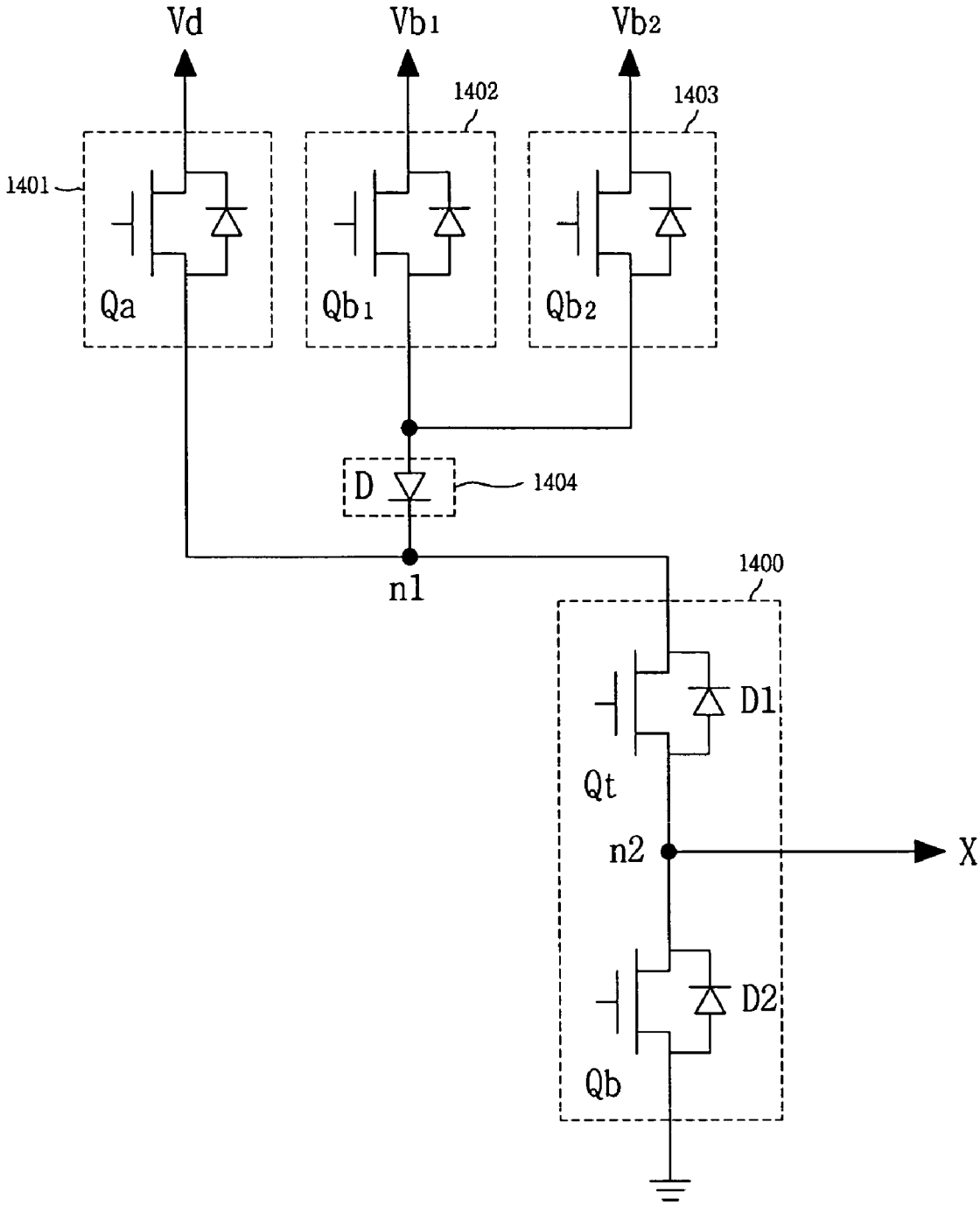
FIG. 14 is a circuit diagram of a plasma display apparatus comprising two bias voltage supply control switches according to another embodiment of the present invention.

FIG. 14 is a circuit diagram of a plasma display apparatus comprising two bias voltage supply control switches according to another embodiment of the present invention.

Referring to FIG. 14, the number of bias voltage supply control switches for supplying bias voltages Vb1 and Vb2 is two (1402 and 1403).

In other words, the plasma display apparatus according to another embodiment of the present invention comprises a first bias voltage supply control switch 1402, Qb1 and a second bias voltage supply control switch 1403, Qb2.

In FIG. 14, the number of the bias voltage supply control switches 1402 and 1403 is two and the remaining constituents are the same as those of the plasma display apparatus shown in FIG. 7 according to an embodiment of the present invention, and description thereof will be omitted for simplicity.

In this case, the first bias voltage supply control switch 1402, Qb1 supplies the first bias voltage Vb1, which is received from a first bias voltage source (not shown), to a data drive IC 1400.

Furthermore, the second bias voltage supply control switch 1403, Qb2 supplies the second bias voltage Vb2, which is received from a second bias voltage source (not shown), to the data drive IC 1400.

FIG. 14 shows an example in which a reverse blocking unit 1404 is further disposed between a first node n1 between a data voltage supply control switch 1401, Qa and the data drive IC 1400, and the plurality of bias voltage supply control switches 1402 and 1403.

However, the reverse blocking unit 1404 may be omitted.

In this case, the first bias voltage Vb1 and the second bias voltage Vb2 that are supplied through the first bias voltage supply control switch 1402, Qb1 and the second bias voltage supply control switch 1403, Qb2, respectively, have a magnitude of a voltage that does not generate an address discharge in the address period.

In this case, each of the first bias voltage Vb1 and the second bias voltage Vb2 may be preferably higher than a voltage of the ground level GND and be lower than the voltage Vd of the data signal. In other words, the relationship "0V<Vb1, Vb2<Vd" may be established.

The operation of the plasma display apparatus shown in FIG. 14 according to another embodiment of the present invention will be described below with reference to FIG. 15.

Figure 15:
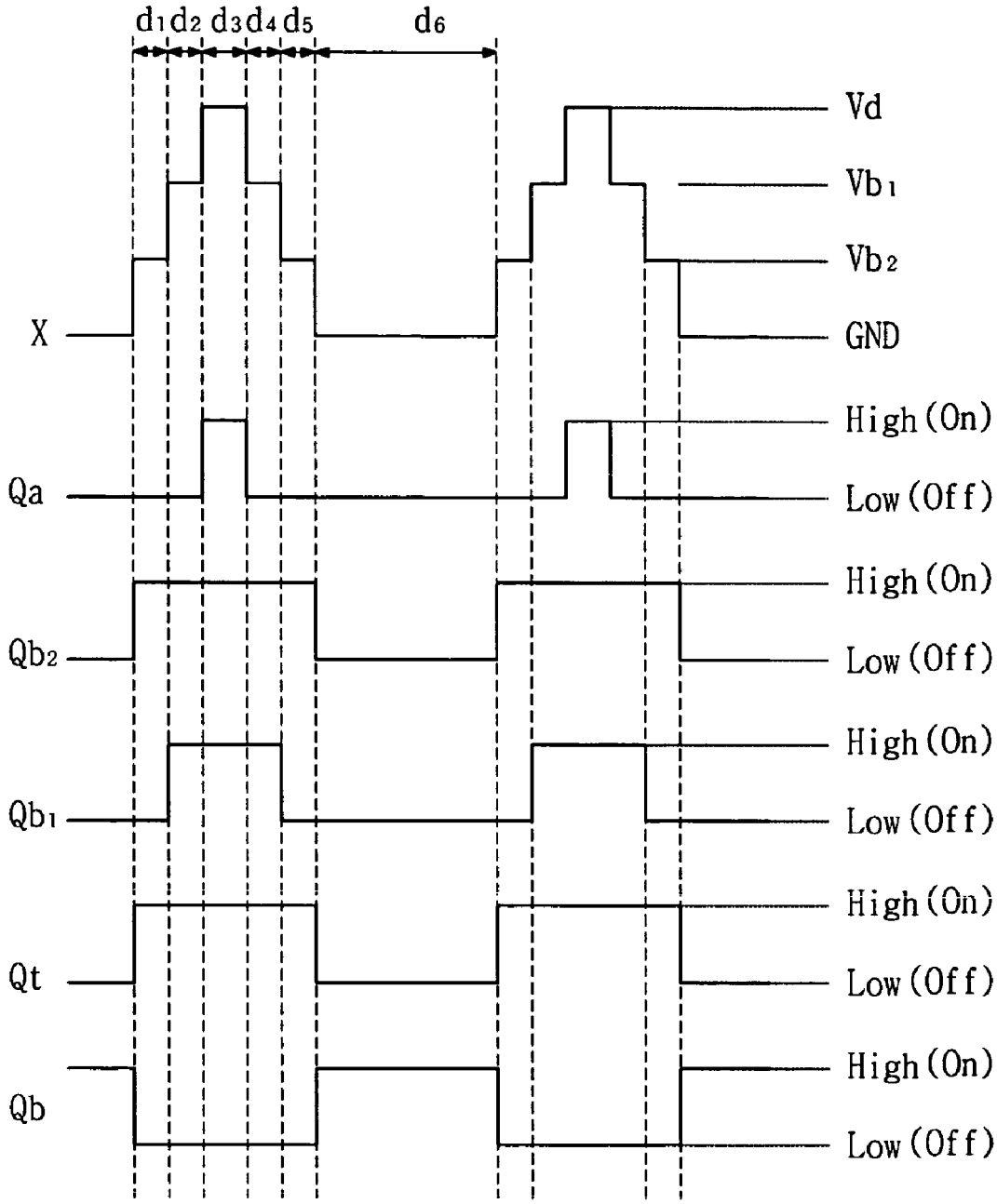
FIG. 15 is an operating timing diagram illustrating the operation of the plasma display apparatus shown in FIG. 14 according to another embodiment of the present invention.

FIG. 15 is an operating timing diagram illustrating the operation of the plasma display apparatus shown in FIG. 14 according to another embodiment of the present invention.

Referring to FIG. 15, if the top switch Qt of the data drive IC 1400 is turned on, the bottom switch Qb of the data drive IC 1400 is turned off, and the second bias voltage supply control switch 1403, Qb2 is turned on in the address period in FIG. 14, the second bias voltage Vb2 is supplied from the second bias voltage source (not shown) to the address electrode X through the first node n1 to the top switch Qt and the second node n2 of the above-mentioned data drive IC 1400.

Therefore, as in a period d1 of FIG. 15, a voltage of the address electrode X rises to the second bias voltage Vb2.

In this case, the second bias voltage Vb2 is preferably higher than the voltage of the ground level GND and is lower than the voltage Vd of the data signal. Accordingly, an address discharge is not generated in the period d1.

Thereafter, if the top switch Qt of the data drive IC 1400 is turned on, the bottom switch Qb of the data drive IC 1400 is turned off, and the first bias voltage supply control switch 1402, Qb1 is turned on with the second bias voltage supply control switch 1403, Qb2 being turned on in the address period in FIG. 14, the first bias voltage Vb1 is supplied from the first bias voltage source (not shown) to the address electrode X through the first node n1 to the top switch Qt and the second node n2 of the data drive IC 1400.

Accordingly, as in a period d2 of FIG. 15, the voltage of the address electrode X rises from the second bias voltage Vb2 to the first bias voltage Vb1.

In this case, the first bias voltage Vb1 is preferably higher than the voltage of the ground level GND and is lower than the voltage Vd of the data signal. Accordingly, an address discharge is not generated in the period d2 in the same manner as the period d1.

Thereafter, if the top switch Qt of the data drive IC 1400 is turned on, the bottom switch Qb of the data drive IC 1400 is turned off, the second bias voltage supply control switch 1403, Qb2 is turned on, and the data voltage supply control switch 1401, Qa is turned on with the first bias voltage supply control switch 1402, Qb1 being turned on in the address period in FIG. 14, the voltage Vd of the data signal is supplied from the data voltage source (not shown) to the address electrode X through the first node n1 to the top switch Qt and the second node n2 of the data drive IC 1400.

Therefore, as in a period d3 of FIG. 15, the voltage of the address electrode X rises from the first bias voltage Vb1 to the voltage Vd of the data signal.

In this case, an address discharge is generated in the period d3 by means of a difference between the voltage Vd of the data signal and the voltage of the scan signal supplied to the scan electrode Y.

Accordingly, the scanning of the scan electrode Y is performed.

Thereafter, if the top switch Qt of the data drive IC 1400 is turned on, the bottom switch Qb of the data drive IC 1400 is turned off, the second bias voltage supply control switch 1403, Qb2 is turned on, and the data voltage supply control switch 1401, Qa is turned off with the first bias voltage supply control switch 1402, Qb1 being turned on in the address period in FIG. 14, the supply of the voltage Vd of the data signal from the data voltage source (not shown) is blocked.

Therefore, as in a period d4 of FIG. 15, the voltage of the address electrode X falls from the voltage Vd of the data signal to the first bias voltage Vb1.

As a result, an address discharge is not generated in the period d4 in the same manner as the above-described periods d1 and d2.

Thereafter, if the top switch Qt of the data drive IC 1400 is turned on, the bottom switch Qb of the data drive IC 1400 is turned off, and the first bias voltage supply control switch 1402, Qb1 is turned off with the second bias voltage supply control switch 1403, Qb2 being turned on in the address period in FIG. 14, the supply of the first bias voltage Vb1 from the first bias voltage source (not shown) is blocked.

Accordingly, as in a period d5 of FIG. 15, the voltage of the address electrode X falls from the first bias voltage Vb1 to the second bias voltage Vb2.

As a result, an address discharge is not generated in the period d5 in the same manner as the above-described periods d1 and d2.

Thereafter, if the top switch Qt of the data drive IC 1400 is turned off and the bottom switch Qb of the data drive IC 1400 is turned on, the voltage of the ground level GND is supplied from the base voltage source (not shown) to the address electrode X through the bottom switch Qb of the data drive IC 1400.

Accordingly, as in a period d6 of FIG. 15, the voltage of the address electrode X falls from the bias voltage Vb to the voltage of the ground level GND.

Heat generated from the plasma display apparatus shown in FIG. 14 according to another embodiment of the present invention, which operates as described above, will be described below.

For example, it is assumed that a magnitude of the voltage Vd of the data signal supplied by the data voltage source (not shown) may be 60V and a magnitude of the first bias voltage Vb1 supply by the first bias voltage source (not shown) may be 40V, which is approximately ⅔ of the voltage Vd of the data signal.

It is also assumed that a magnitude of the second bias voltage Vb2 supplied by the second bias voltage source (not shown) is 20V, which is approximately ⅓ of the voltage Vd of the data signal.

Furthermore, it is assumed that an equivalent resistance value of the top switch Qt of the data drive IC 1400 is R1, an equivalent resistance value of the data voltage supply control switch 1401, Qa is R2, an equivalent resistance value of the first bias voltage supply control switch 1402, Qb1 is R3, and an equivalent resistance value of the second bias voltage supply control switch 1403, Qb2 is R4.

In this case, when the second bias voltage Vb2 is supplied to the address electrode X through the data drive IC (reference numeral "1400") of FIG. 14, a current flowing through the top switch Qt1 and a magnitude of power consumed at the top switch Qt1 can be expressed in the following equation 4.

$$ia=20V/(R1+R4)$$

$$Wa=ia\times 20V \qquad \text{[Equation 4]}$$

Here "ia" denotes a magnitude of a current flowing through the top switch Qt of the data drive IC 1400 when the second bias voltage Vb2 is supplied to the address electrode X, and "Wa" denotes a magnitude of power consumed at the top switch Qt.

From Equation 4, it can be seen that the top switch Qt of the above-mentioned data drive IC 1400 consumes Wa (i.e., power of ia×20V) when the bias voltage Vb is supplied.

At this time, heat is generated from the top switch Qt in proportion to the consumption power Wa.

For example, assuming that the resistance value R1 of the top switch Qt is 30Ω (ohm), which is the same as that of the top switch Qt1 in FIG. 1 and an equivalent resistance R4 of the first bias voltage supply control switch 1403, Qb2 is also 30Ω (ohm), heat as much as approximately (20/60)×20=7 W is generated from the top switch Qt.

Furthermore, when the first bias voltage Vb1 is supplied from the second bias voltage Vb2 to the address electrode X through the data drive IC (reference numeral "1400") of FIG. 14, a current flowing through the top switch Qt1 and a magnitude of power consumed at the top switch Qt1 can be expressed in the following equation 5.

$$ib=(40-20)V/(R1+R3)$$

$$Wb=ib\times(40-20)V \quad \text{[Equation 5]}$$

Here "ib" denotes a magnitude of a current flowing through the top switch Qt of the data drive IC 1400 when the first bias voltage Vb1 is supplied from the second bias voltage Vb2 to the address electrode X, and "Wa" denotes a magnitude of power consumed at the top switch Qt.

Referring to Equation 5, a magnitude of a voltage applied to the top switch Qt of the data drive IC 1400 when the first bias voltage Vb1, which is assumed to be 40V, is 20V.

This is because as the second bias voltage Vb2 is supplied before the voltage Vd of the data signal is supplied, a shift amount of a voltage at the top switch Qt of the data drive IC 1400 is 20V.

Accordingly, it can be seen that the top switch Qt of the above-mentioned data drive IC 1400 consumes power of Wb (i.e., power of ib×20V) when the first bias voltage Vb1 is supplied. At this time, heat is generated from the top switch Qt in proportion to the consumption power Wb.

For example, assuming that the resistance value R1 of the top switch Qt is 30Ω (ohm), which is the same as that of the top switch Qt1 in FIG. 1 and an equivalent resistance R3 of the data voltage supply control switch 1402, Qb1 is also 30Ω (ohm), heat as much as (20/60)×20=7 W is generated from the top switch Qt.

Furthermore, when the voltage Vd of the data signal is supplied from the first bias voltage Vb1 to the address electrode X through the data drive IC (reference numeral "1400") in FIG. 14, a current flowing through the top switch Qt1 and a magnitude of power consumed at the top switch Qt1 can be expressed in the following equation 6.

$$ic=(60-40)V/(R1+R2)$$

$$Wc=ic\times(60-40)V \quad \text{[Equation 6]}$$

Here "ic" denotes a magnitude of a current flowing through the top switch Qt of the data drive IC 1400 when the voltage Vd of the data signal is supplied from the first bias voltage Vb1 to the address electrode X, and "Wa" denotes a magnitude of power consumed at the top switch Qt.

Referring to Equation 6, a magnitude of a voltage applied to the top switch Qt of the data drive IC 1400 when the voltage Vd of the data signal, which is assumed to be 60V, is 20V.

This is because as the first bias voltage Vb1 is supplied before the voltage Vd of the data signal is supplied, a shift amount of a voltage at the top switch Qt of the data drive IC 1400 is 20V.

Accordingly, it can be seen that the top switch Qt of the above-mentioned data drive IC 1400 consumes power of Wc (i.e., power of ic×20V) when the voltage Vd of the data signal is supplied. At this time, heat is generated from the top switch Qt in proportion to the consumption power Wb.

For example, assuming that the resistance value R1 of the top switch Qt is 30Ω (ohm), which is the same as that of the top switch Qt1 in FIG. 1, and an equivalent resistance R2 of the data voltage supply control switch 1401, Qa is also 30Ω (ohm), heat as much as approximately (20/60)×20=7 W is generated from the top switch Qt.

In summary, a magnitude of heat generated from the top switch Qt of the data drive IC 1400 is proportional to the sum of approximately 7 W when the second bias voltage Vb2 is supplied, approximately 7 W when the first bias voltage Vb1 is supplied, and approximately 7 W when the voltage Vd of the data signal is supplied.

In other words, heat is generated from the top switch Qt of the data drive IC 1400 in proportion to power consumption of a total of approximately 21 W upon driving.

As a result, in the plasma display apparatus of the present invention, an amount of heat generated from the top switch Qt of the data drive IC is about ⅙ compared with the related art as shown in FIG. 1.

In this case, it is preferred that the equivalent resistance value R3 of the first bias voltage supply control switch 1402, Qb1 and the equivalent resistance value R4 of the second bias voltage supply control switch 1403, Qb2 be approximately the same so that heat generated from the first bias voltage supply control switch 1402, Qb1 and the second bias voltage supply control switch 1403, Qb2 of FIG. 14 does not lean to one of them.

Furthermore, more preferably, it is required that magnitudes of the first bias voltage and the second bias voltage be controlled properly so that heat generated from the first bias voltage supply control switch 1402, Qb1 and the second bias voltage supply control switch 1403, Qb2 of FIG. 14 does not lean to one of them.

In more detail, it is preferred that a difference between the voltage Vd of the data signal and the first bias voltage Vb1 and a difference between the first bias voltage Vb1 and the second bias voltage Vb2 are approximately the same.

For example, assuming that the voltage Vd of the data signal is 90V, the first bias voltage Vb1 is approximately 60V, which is 30V lower than the voltage Vd of the data signal. Furthermore, the second bias voltage Vb2 lower than the first bias voltage Vb1 is approximately 30V, which is 30V lower than the first bias voltage Vb1.

It has been shown in FIG. 14 that the number of the bias voltage supply control switches is two (i.e., 1402 and 1403). It is, however, preferred that the number of the bias voltage supply control switches is set to range from 2 to 5. The number of the bias voltage supply control switches may be varied depending on a total amount of heat generated upon driving, a magnitude of the voltage Vd of the data signal and/or the bias voltage Vb.

However, considering the production cost of the plasma display apparatus according to another embodiment of the present invention, it is more preferred that the number of the bias voltage supply control switches is set to range from 2 to 3.

Unlike FIG. 14, an example in which the number of the bias voltage supply control switches is three will be described below with reference to FIG. 16.

Figure 16:
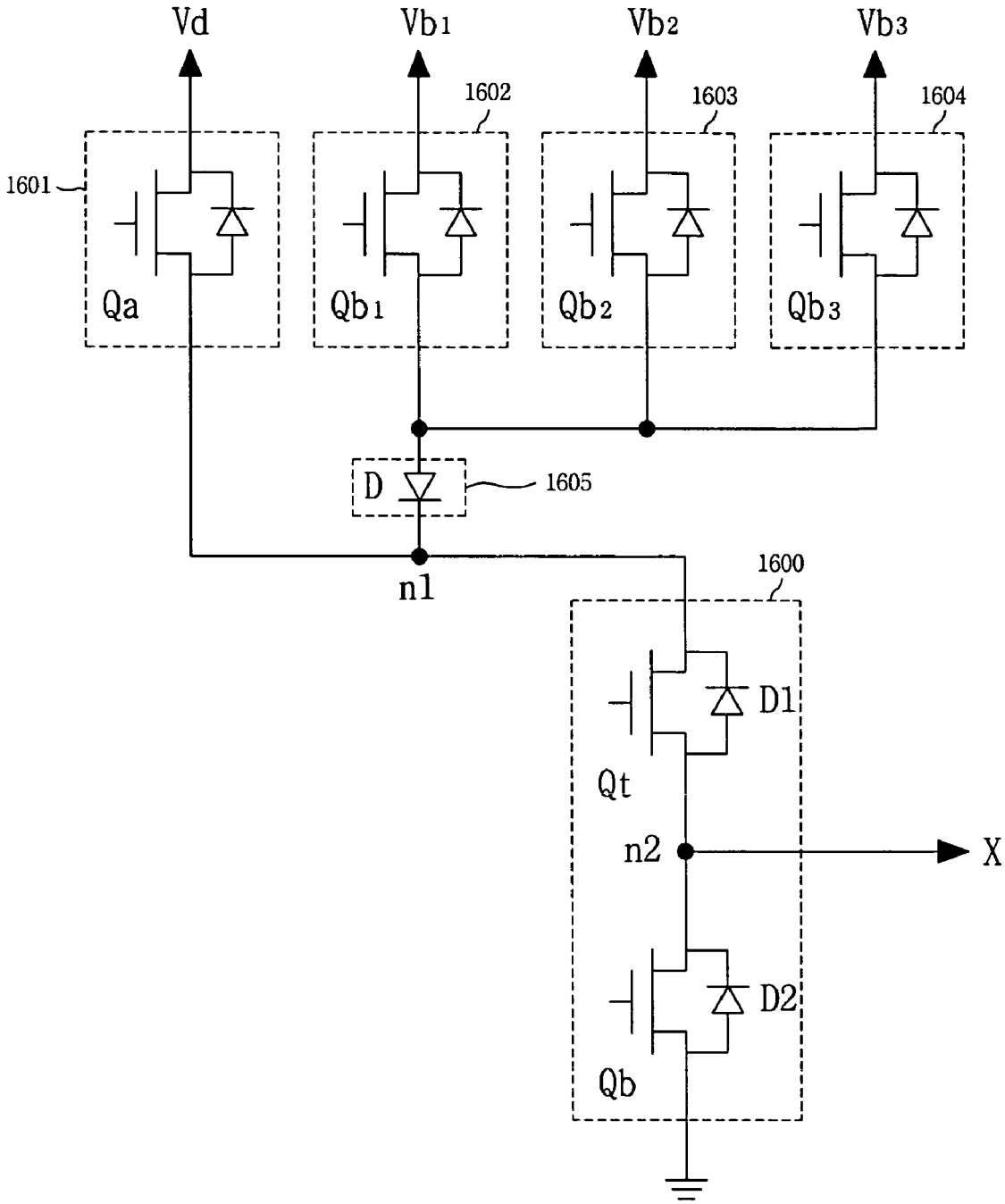
FIG. 16 is a circuit diagram of a plasma display apparatus comprising three bias voltage supply control switches according to still another embodiment of the present invention.

FIG. 16 is a circuit diagram of a plasma display apparatus comprising three bias voltage supply control switches according to further another embodiment of the present invention.

Referring to FIG. 16, the number of bias voltage supply control switches for supplying bias voltages Vb1, Vb2, and Vb3 is three (1602, 1603, and 1604).

In other words, the plasma display apparatus according to another embodiment of the present invention comprises a first bias voltage supply control switch 1602, Qb1, a second bias voltage supply control switch 1603, Qb2, and a third bias voltage supply control switch 1604, Qb3.

In FIG. 16, the number of the bias voltage supply control switches 1602, 1603, and 1604 is three and the remaining constituents are the same as those of the plasma display apparatus shown in FIG. 7, and description thereof will be omitted for simplicity.

In this case, the first bias voltage supply control switch 1602, Qb1 supplies the first bias voltage Vb1, which is supplied from a first bias voltage source (not shown), to a data drive IC 1600.

Furthermore, the second bias voltage supply control switch 1603, Qb2 supplies the second bias voltage Vb2, which is supplied from a second bias voltage source (not shown), to the data drive IC 1600.

Furthermore, the third bias voltage supply control switch 1604, Qb3 supplies the third bias voltage Vb3, which is supplied from a third bias voltage source (not shown), to the data drive IC 1600.

FIG. 16 illustrates an example in which a reverse blocking unit 1605 is further comprised between a first node n1 between a data voltage supply control switch 1601, Qa and the data drive IC 1600, and the plurality of bias voltage supply control switches 1602, 1603, and 1604.

However, the reverse blocking unit 1605 may be omitted, if appropriate.

In this case, the first bias voltage Vb1, the second bias voltage Vb2, and the third bias voltage Vb3 that are supplied through the first bias voltage supply control switch 1602, Qb1, the second bias voltage supply control switch 1603, Qb2, and the third bias voltage supply control switch 1604, Qb3, respectively, have a magnitude of a voltage that does not generate the address discharge in the address period.

In this case, it is preferred that each of the first bias voltage Vb1, the second bias voltage Vb2, and the third bias voltage Vb3 be higher than a voltage of a ground level GND and is lower than a voltage Vd of the data signal.

In other words, the relationship 0V<Vb1, Vb2, Vb3<Vd is established.

In FIG. 16, it is also preferred that an equivalent resistance value of the first bias voltage supply control switch 1602, Qb1, an equivalent resistance value of the second bias voltage supply control switch 1603, Qb2, and an equivalent resistance value of the third bias voltage supply control switch 1604, Qb3 be approximately the same so that heat generated from the first bias voltage supply control switch 1602, Qb1, the second bias voltage supply control switch 1603, Qb2, and the third bias voltage supply control switch 1604, Qb3 does not lean to any one of them, as in FIG. 14.

Furthermore, it is more preferred that magnitudes of the first bias voltage Vb1, the second bias voltage Vb2, and the third bias voltage Vb3 be controlled properly so that heat generated from the first bias voltage supply control switch 1602, Qb1, the second bias voltage supply control switch 1603, Qb2, and the third bias voltage supply control switch 1604, Qb3 of FIG. 16 does not lean to any one of them.

In more detail, it is preferred that a difference between the voltage Vd of the data signal and the first bias voltage Vb1, a difference between the first bias voltage Vb1 and the second bias voltage Vb2, and a difference between the second bias voltage Vb2 and the third bias voltage Vb3 be approximately the same.

For example, assuming that the voltage Vd of the data signal is 80V, the first bias voltage Vb1 is approximately 60V, which is 20V lower than the voltage Vd of the above-described data signal.

Furthermore, the second bias voltage Vb2 lower than the above-described first bias voltage Vb1 is approximately 40V, which is 20V lower than the above-described first bias voltage Vb1, and the third bias voltage Vb3 lower than the second bias voltage Vb2 is approximately 30V, which is 20V lower than the above-described second bias voltage Vb2.

The operation of the plasma display apparatus shown in FIG. 16 according to another embodiment of the present invention will be described below with reference to FIG. 17.

Figure 17:
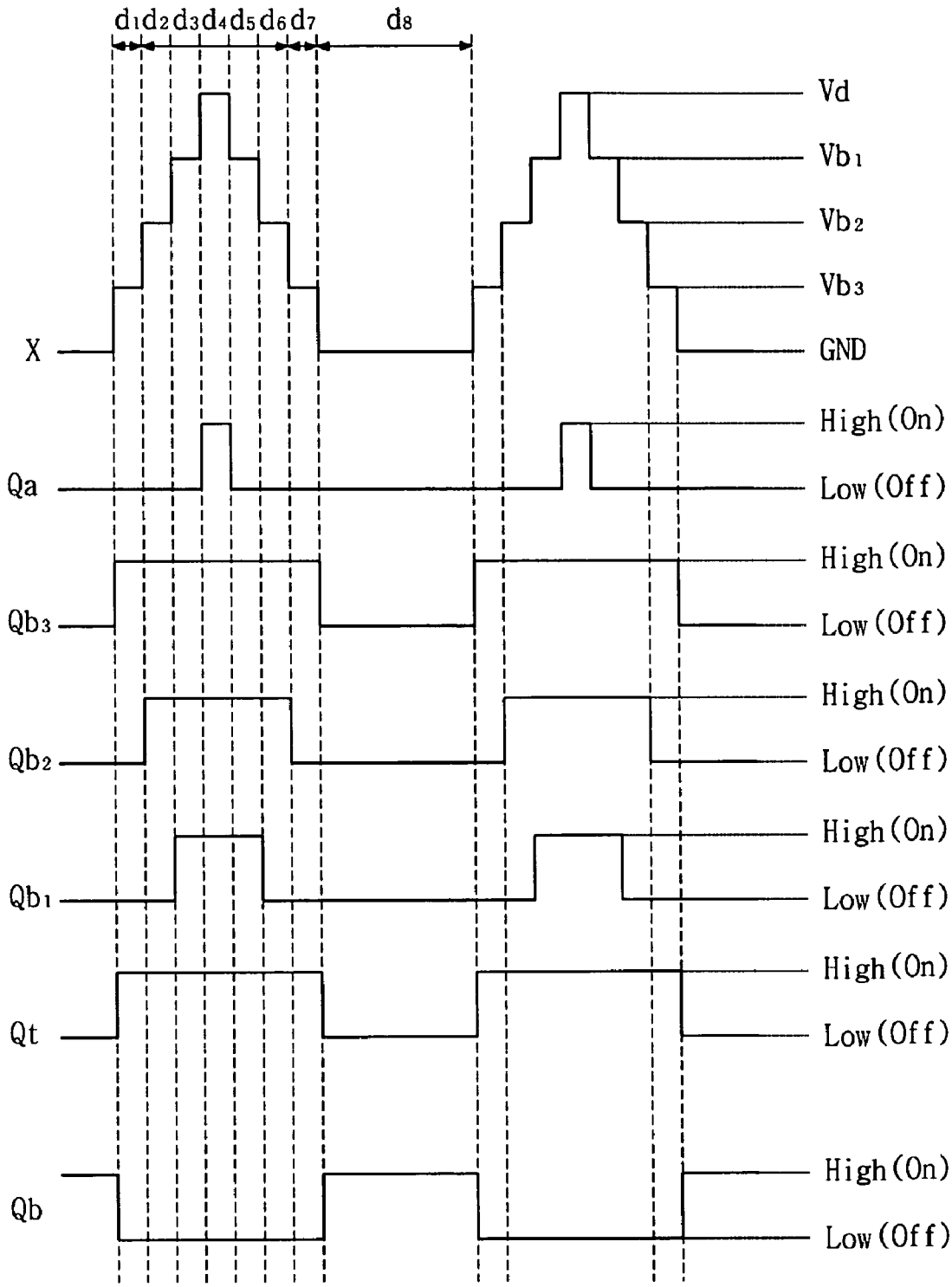
FIG. 17 is an operating timing diagram illustrating the operation of the plasma display apparatus shown in FIG. 16 according to still another embodiment of the present invention.

FIG. 17 is an operating timing diagram illustrating the operation of the plasma display apparatus shown in FIG. 16 according to further another embodiment of the present invention.

Referring to FIG. 17, as the third bias voltage supply control switch 1604, Qb4, the second bias voltage supply control switch 1603, Qb2, the first bias voltage supply control switch 1602, Qb1, and the data voltage supply control switch 1601, Qa are sequentially turned on, the voltage of the address electrode X ascend stepwise from the third bias voltage Vb3 to the second bias voltage Vb2, the first bias voltage Vb1 to the voltage Vd of the data signal.

The operating timing in FIG. 17 is approximately the same as that of FIG. 15. Accordingly, since the operating timing of FIG. 17 can be easily understood through the description of FIG. 15, further description about the operating timing in FIG. 17 will be omitted.

When the number of the bias voltage supply control switches is plural as in FIG. 14 or 16, a magnitude of the bias voltage supplied through the bias voltage supply control switch can be controlled depending on the number of the bias voltage supply control switches.

This will be described in detail below with reference to FIG. 18.

Figure 18:
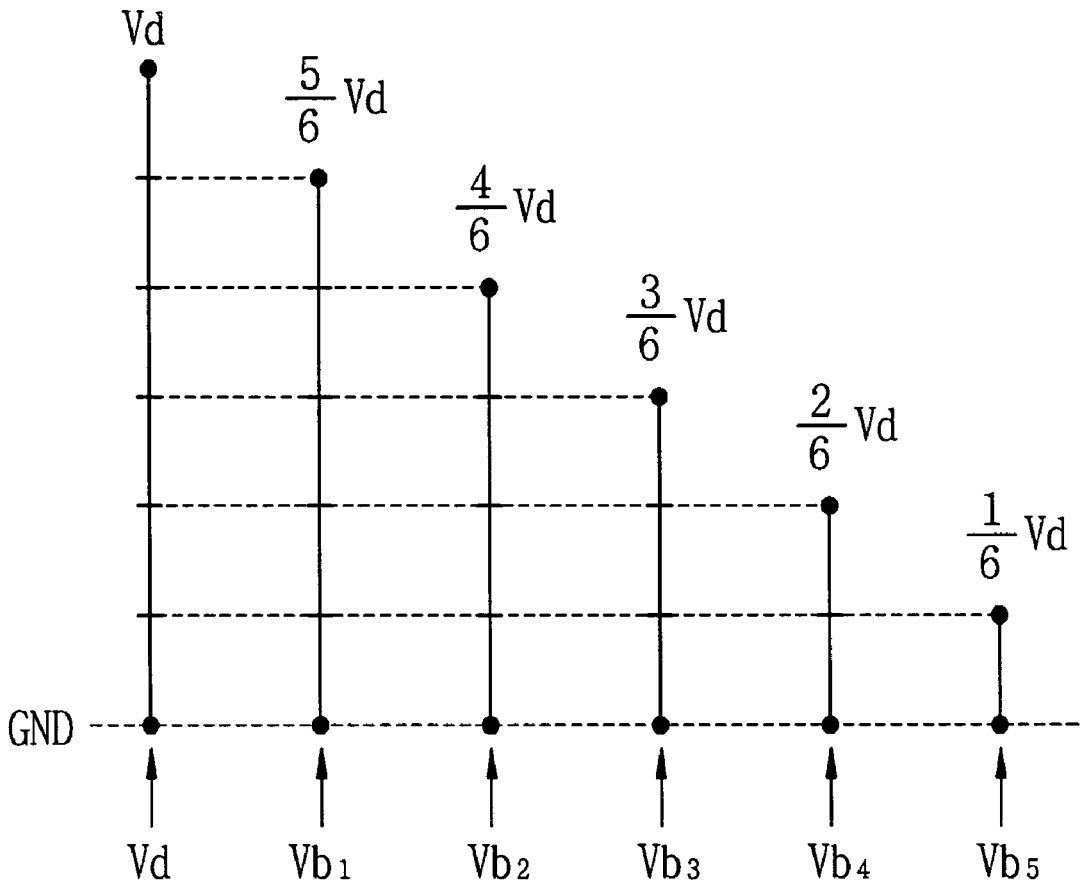
FIG. 18 is a view illustrating an exemplary method of controlling a magnitude of a bias voltage depending on the number of bias voltage supply control switches.

FIG. 18 is a view illustrating an exemplary method of controlling a magnitude of a bias voltage depending on the number of bias voltage supply control switches.

FIG. 18 shows a magnitude of a bias voltage when the number of the bias voltage supply control switches is 5 in total.

Voltages supplied through the five bias voltage supply control switches are a first bias voltage Vb1, a second bias voltage Vb2, a third bias voltage Vb3, a fourth bias voltage Vb4, and a fifth bias voltage Vb5.

It is assumed that the magnitudes of the voltages are sequentially increased in order of the fifth bias voltage Vb5, the fourth bias voltage Vb4, the third bias voltage Vb3, the second bias voltage Vb2, and the first bias voltage Vb1.

In this case, the first bias voltage Vb1 is 5/6 times the voltage Vd of the data signal, the second bias voltage Vb2 is 4/6 times the voltage Vd of the data signal, the third bias voltage Vb3 is 3/6 times the voltage Vd of the data signal, the fourth bias voltage Vb4 is 2/6 times the voltage Vd of the data signal, and the fifth bias voltage Vb5 is 1/6 times the voltage Vd of the data signal.

The reason why the magnitudes of the bias voltages are controlled as described above is that it can prevent the occurrence of heat from being concentrated in any one of the plurality of bias voltage supply switches, as described above.

As described above in detail, the plasma display apparatus of the present invention can reduce an amount of heat generated in the switching elements (preferably, the data drive IC) in comparison with the related art.

Furthermore, relatively small heat that is generated in the data drive IC when the plasma display apparatus of the present invention is driven can be dissipated through the heat sink effectively. This example will be described below with reference to FIG. 19.

Figure 19:
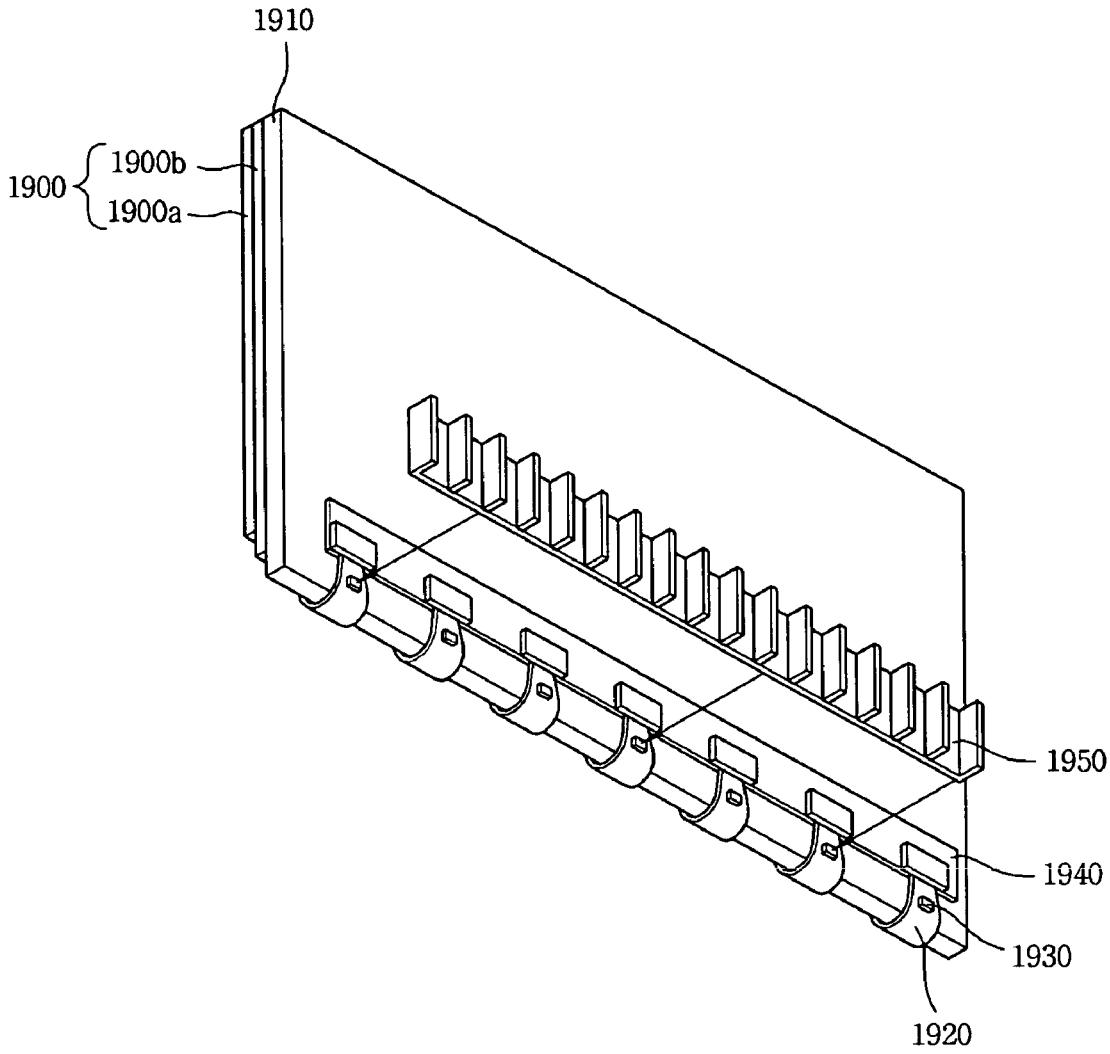
FIG. 19 is a perspective view illustrating an example of a structure using a heat sink in order to dissipate the heat of data drive IC when the plasma display apparatus is driven according to an embodiment of the present invention.

FIG. 19 is a perspective view illustrating an example of a structure using a heat sink in order to dissipate the heat of data drive ICs when the plasma display apparatus is driven according to an embodiment of the present invention.

FIG. 19 illustrates an example of a structure for dissipating heat generated from the data drive IC in the plasma display apparatus according to an embodiment of the present invention. It is, however, to be understood that the present invention is not limited to the structure of FIG. 19.

Referring to FIG. 19, a first panel 1900*a* and a second panel 1900*b* are coalesced as in FIG. 4. Though not shown in the drawing, a frame 1910 is formed on a rear surface of a plasma display panel 1900 in which a plurality of address electrodes X are formed.

A data board 1940 for supplying a predetermined driving voltage to the address electrodes X formed in the plasma display panel 1900 is formed on the frame 1910.

Film type elements 1920 are used to electrically connect the data board 1940 formed on the frame 1910 and the address electrodes X formed in the plasma display panel 1900.

More preferably, a TCP (i.e., one of the film type elements) is used as the film type elements 1920.

Furthermore, a data drive IC 1930 is mounted on each film type element 1920.

The data drive IC 1930 performs a switching operation in order to apply a voltage Vd of a data signal and a bias voltage Vb to the address electrodes X formed in the plasma display panel 1900 according to a driving signal generated from the data driver 1940.

As described above, in the plasma display apparatus according to an embodiment of the present invention, an amount of heat generated when the data drive IC 1930 that performs the switching operation so as to supply the voltage Vd of the data signal and the bias voltage Vb is driven is relatively smaller than that of the conventional data drive IC as shown in FIG. 1. This has been described in detail in the above.

It is more preferred that heat sinks 1950 are used to dissipate heat generated from the data drive IC 1930 according to an embodiment of the present invention, which generates relatively small heat compared with the related art.

This is because although relatively small heat compared with the related art is generated when the data drive IC according to an embodiment of the present invention is driven, it is more advantageous to dissipate the heat generated from the data drive IC outside the data drive IC in terms of stability.

As described above, the heat sink 1950 for dissipating the heat generated from the data drive IC 1930 according to an embodiment of the present invention may have a large volume compared with that of the related art.

This will be described below with reference to FIGS. 20 and 21.

Figure 20:
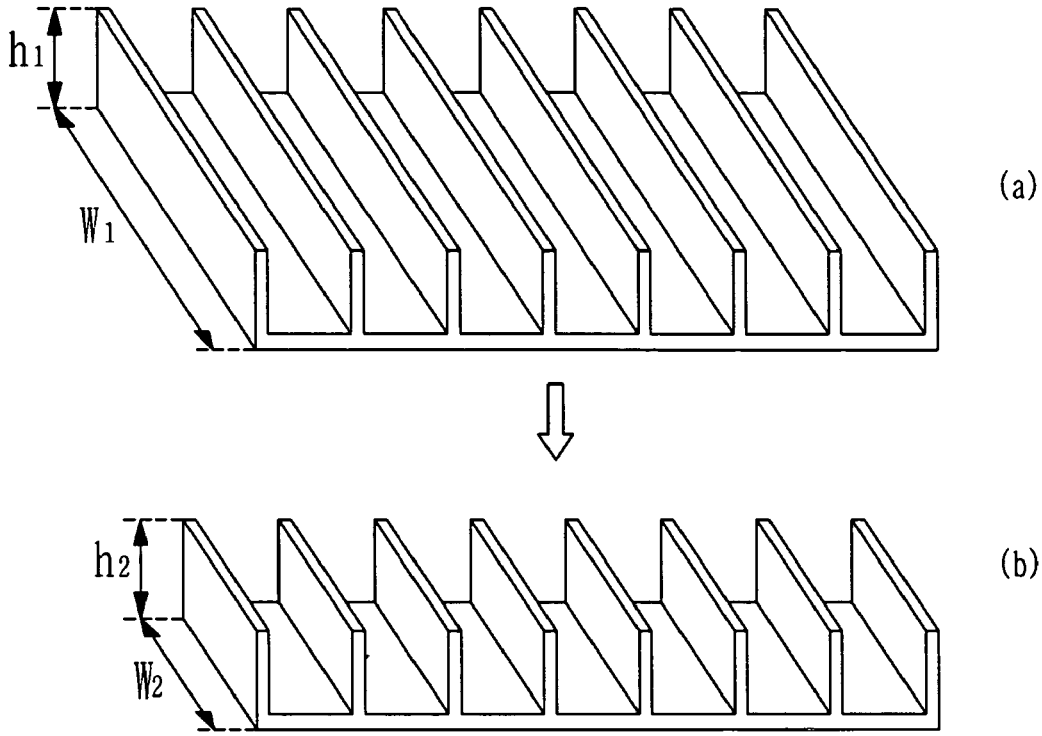
FIG. 20 is a perspective view illustrating an example of a heat sink structure for dissipating heat generated from the data drive IC of the plasma display apparatus according to an embodiment of the present invention.

FIG. 20 is a perspective view illustrating an example of a heat sink structure for dissipating heat generated from the data drive IC of the plasma display apparatus according to an embodiment of the present invention.

Figure 21:
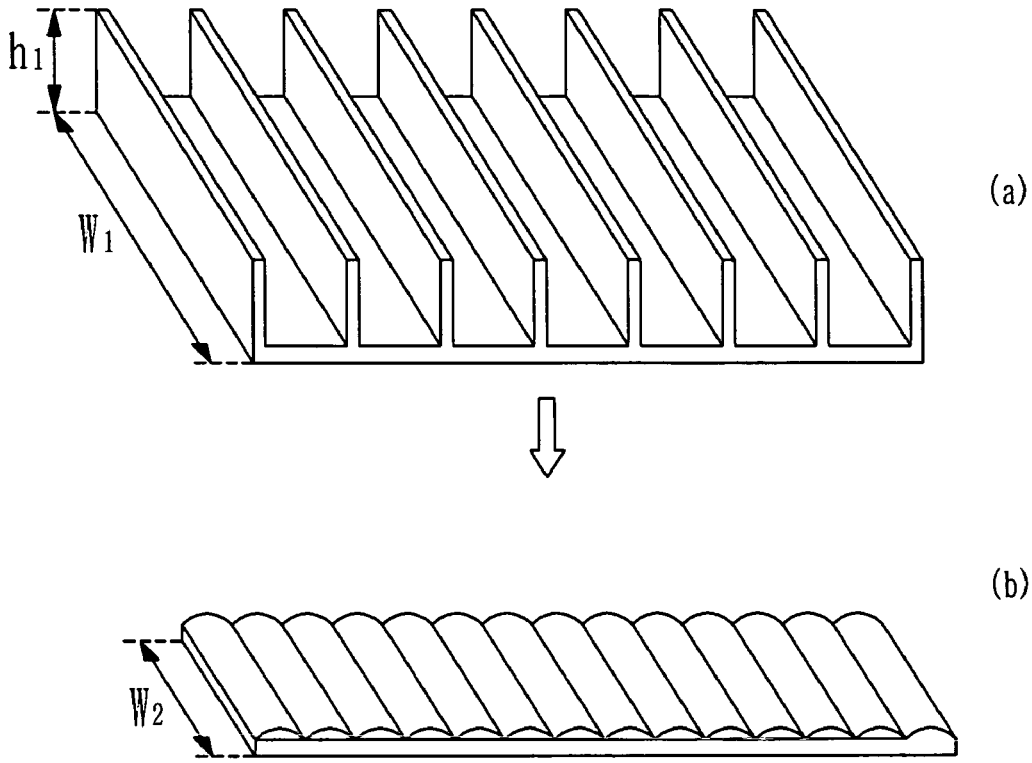
FIG. 21 is a perspective view illustrating another example of a heat sink structure for dissipating heat generated from the data drive IC of the plasma display apparatus according to an embodiment of the present invention.

FIG. 21 is a perspective view illustrating another example of a heat sink structure for dissipating heat generated from the data drive IC of the plasma display apparatus according to an embodiment of the present invention.

FIG. 20(*a*) shows a heat sink for dissipating heat, which is generated from the data drive IC of the conventional plasma display apparatus as shown in FIG. 1, to the outside.

Referring to FIG. 20(*a*), the heat sink for dissipating heat generated from the data drive IC in the related art to the outside is W1 in a horizontal width and is h1 in a height of one heat sink fin.

Heat dissipation efficiency of the heat sink for dissipating heat generated from the data drive IC is increased in proportion to the volume of the heat sink or the surface area of the heat sink.

In contrast, FIG. 20(*b*) shows a heat sink for dissipating heat externally, which is generated from the data drive IC of the plasma display apparatus as shown in FIG. 7 according to an embodiment of the present invention.

Referring to FIG. 20(*b*), the heat sink for dissipating heat generated from the data drive IC of the plasma display apparatus according to an embodiment of the present invention is W2 in a horizontal width and is h2 in the height of one heat sink fin.

In this case, the relationships W2<W1 and h2<h1 are established.

In other words, the size of the heat sink for dissipating heat generated from the data drive IC of the plasma display to the outside apparatus according to an embodiment of the present invention is smaller than that of the related art.

More particularly, the surface area and/or volume of the heat sink shown in FIG. 20(*b*) are smaller than those of the heat sink shown in FIG. 20(*a*).

The reason why the surface area and/or volume of the heat sink used in the plasma display apparatus as shown in FIG. 20(*b*) can be made smaller than those of the related art as shown in FIG. 20(*a*) as described above is that heat generated from the data drive IC used in the plasma display apparatus according to an embodiment of the present invention has been significantly reduced compared with the related art.

By making the volume and surface area of the heat sink used in the plasma display apparatus of the present invention smaller than those of the related art as described above, an overall production cost can be lowered.

FIG. 21(*a*) shows a heat sink for dissipating heat externally, which is generated from the data drive IC of the conventional plasma display apparatus as shown in FIG. 1 in the same manner as FIG. 20(*a*).

In contrast, FIG. 21(*b*) shows another heat sink for dissipating heat externally, which is generated from the data drive IC of the plasma display apparatus as shown in FIG. 7 according to an embodiment of the present invention.

Referring to FIG. 21(*b*), the heat sink for dissipating heat externally, which is generated from the data drive IC of the plasma display apparatus according to an embodiment of the present invention has a horizontal width W2, which is smaller than W1 in FIG. 21(*a*) and does not comprise the heat sink fin shown in FIG. 21(*a*).

However, a predetermined curve is formed on the surface of the heat sink shown in FIG. 21(*b*).

The reason why the heat sink fin can be omitted in the heat sink used in the plasma display apparatus as shown in FIG. 21(*b*) according to an embodiment of the present invention as described above is that heat generated from the data drive IC used in the plasma display apparatus according to an embodiment of the present invention has been significantly reduced in comparison with the related art.

By omitting the heat sink fin from the heat sink used in the plasma display apparatus of the present invention as described above, not only the volume and surface area of the heat sink can be made smaller than those of the related art, but also the fabrication of the heat sink is more facilitated. It is therefore possible to significantly lower an overall production cost.

The present invention is advantageous in that it can prevent thermal and electrical damage of the data drive IC and can improve an overall operational stability of the plasma display apparatus.

Furthermore, although a withstanding voltage characteristic of the data drive IC is lowered, a stabilized operation is possible. Accordingly, the present invention is advantageous in that it can lower the production cost.

Furthermore, the volume and/or surface area of the heat sink for dissipating heat generated from the data drive IC can be made relatively smaller than those of the related art. Accordingly, the present invention is advantageous in that it can lower the production cost.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus comprising:

a plasma display panel comprising an address electrode;

a data drive integrated circuit (IC), connected to the address electrode, for supplying a voltage of a data signal supplied from a data voltage source and a bias voltage supplied from a bias voltage source to the address electrode;

a bias voltage supply control switch for controlling the bias voltage supplied by the data drive IC; and a data voltage supply control switch for controlling the voltage of the data signal supplied by the data drive IC, wherein the bias voltage is a voltage between a ground level voltage and the voltage of the data signal.

2. The plasma display apparatus of claim 1, wherein the data drive IC is formed on a single board independently of the data voltage supply control switch and the bias voltage supply control switch.

3. The plasma display apparatus of claim 1, wherein the data drive IC comprises a top switch and a bottom switch, one terminal of the top switch is commonly connected to the data voltage supply control switch and the bias voltage supply control switch, an other terminal of the top switch is connected to one terminal of the bottom switch, an other terminal of the bottom switch is grounded, and the address electrode is interposed between the other terminal of the top switch and one terminal of the bottom switch.

4. The plasma display apparatus of claim 1, wherein number of the bias voltage supply control switch is plural, and the plurality of bias voltage supply control switches are connected to a plurality of bias voltage sources for supplying bias voltages of different magnitudes, respectively.

5. The plasma display apparatus of claim 4, wherein the number ranges from 2 to 5.

6. The plasma display apparatus of claim 4, wherein each of the bias voltages of different magnitudes is higher than a ground level voltage and is lower than the voltage of the data signal.

7. The plasma display apparatus of claim 6, wherein the plurality of bias voltage supply control switches each comprise a first bias voltage supply control switch for supplying a first bias voltage and a second bias voltage supply control switch for supplying a second bias voltage lower than the first bias voltage, and a difference between the first bias voltage and the second bias voltage equals a difference between the first bias voltage and the voltage of the data signal.

8. The plasma display apparatus of claim 6, wherein the plurality of bias voltage supply control switches each comprise a first bias voltage supply control switch for supplying a first bias voltage, a second bias voltage supply control switch for supplying a second bias voltage lower than the first bias voltage, and a third bias voltage supply control switch for supplying a third bias voltage lower than the second bias voltage, and a difference between the first bias voltage and the voltage of the data signal equals a difference between the first bias voltage and the second bias voltage and a difference between the second bias voltage and the third bias voltage.

9. The plasma display apparatus of claim 1, further comprising a reverse blocking unit for blocking an inverse current flowing toward the bias voltage source, the blocking unit being interposed between the bias voltage source and the bias voltage supply control switch and/or between a connection terminal of the data drive IC and the data voltage supply control switch and the bias voltage supply control switch.

10. The plasma display apparatus of claim 9, wherein the reverse blocking unit comprises a reverse blocking diode, and an anode of the reverse blocking diode is disposed toward the bias voltage source.

11. A method of driving a plasma display apparatus for driving a plasma display panel comprising a scan electrode and an address electrode, the method comprising:

supplying a reset signal to the scan electrode during a reset period of at least one subfield;

supplying a bias voltage to the address electrode during an address period of the at least one subfield; and supplying a voltage of a data signal to the address electrode during the address period of the at least one subfield, wherein the step of supplying the bias voltage comprises supplying bias voltages of different magnitudes a plurality of times.

12. The method of claim 11, wherein a magnitude of the bias voltage equals half the voltage of the data signal.

13. The method of claim 11, wherein the supplying of the bias voltage comprises supplying a first bias voltage to the address electrode and supplying a second bias voltage to the address electrode, wherein magnitudes of the first bias voltage and the second bias voltage are greater than a ground level voltage and are less than the voltage of the data signal, and wherein a difference between the first bias voltage and the second bias voltage equals a difference between the first bias voltage and the voltage of the data signal.

14. The method of claim 11, wherein the supplying of the bias voltage comprises supplying a first bias voltage to the address electrode, supplying a second bias voltage to the address electrode, and supplying a third bias voltage to the address electrode, wherein magnitudes of the first bias voltage, the second bias voltage, and the third bias voltage are greater than a ground level voltage and are less than the voltage of the data signal, and a difference between the first bias voltage and the voltage of the data signal equals a difference between the first bias voltage and the second bias voltage and a difference between the second bias voltage and the third bias voltage.

15. A method of driving a plasma display apparatus comprising a first substrate comprising a scan electrode and a sustain electrode, a second substrate comprising an address electrode and a barrier rib, and a driver for supplying a driving signal to the address electrode, the method comprising:

supplying a reset signal to the scan electrode during a reset period of at least one subfield;

supplying a bias voltage to the address electrode during an address period of the at least one subfield; and supplying a voltage of a data signal to the address electrode during the address period of the at least one subfield, wherein the step of supplying the bias voltage comprises supplying bias voltages of different magnitudes a plurality of times.

16. The method of claim 15, wherein a magnitude of the bias voltage equals half the voltage of the data signal.

17. The method of claim 15, wherein the address electrode is separated.

* * * * *